US012616308B2

(12) United States Patent
Clabots

(10) Patent No.: US 12,616,308 B2
(45) Date of Patent: May 5, 2026

(54) MODULAR LOUNGE SEATING ASSEMBLY SYSTEM

(71) Applicant: Evan Clabots Design LLC, Brooklyn, NY (US)

(72) Inventor: Evan Clabots, Brooklyn, NY (US)

(73) Assignee: EVAN CLABOTS DESIGN LLC, Brooklyn, NY (US)

( * ) Notice: Subject to any disclaimer, the term of this patent is extended or adjusted under 35 U.S.C. 154(b) by 235 days.

(21) Appl. No.: 18/506,055

(22) Filed: Nov. 9, 2023

(65) Prior Publication Data

US 2024/0156271 A1 May 16, 2024

Related U.S. Application Data

(60) Provisional application No. 63/383,148, filed on Nov. 10, 2022.

(51) Int. Cl.
*A47C 13/00* (2006.01)

(52) U.S. Cl.
CPC ..... *A47C 13/005* (2013.01)

(58) Field of Classification Search
CPC ..... A47C 13/005; A47B 87/00
USPC ..... 108/64; 297/440.14
See application file for complete search history.

(56) References Cited

U.S. PATENT DOCUMENTS 2,942,923 A 6/1960 Herrmann
3,811,728 A * 5/1974 Redemske ..... A47B 87/00 5/2.1
3,983,824 A 10/1976 Birnbaum
4,077,666 A * 3/1978 Heumann ..... A47C 13/005 D6/377
4,383,397 A 5/1983 Ward
5,988,077 A 11/1999 Balderi
6,151,765 A 11/2000 Asplund
(Continued)

FOREIGN PATENT DOCUMENTS

CN 111990818 11/2020
DE 9317453 1/1994
(Continued)

OTHER PUBLICATIONS

ISR and WO for PCT/US/2024/33294 (Sep. 23, 2024).
(Continued)

*Primary Examiner* — Jose V Chen
(74) *Attorney, Agent, or Firm* — Koffsky Schwalb LLC; Mark I. Koffsky

(57) ABSTRACT

A modular lounge seating assembly system includes a universal base platform that has a cavity in the separation between an upper portion and a lower portion. Legs may be installed under one or more of the corners of the universal base platform. The universal base platform may also have pass-through holes in the center of its bottom frame. Two universal base platforms may be joined by a joining plate that is partially inserted into each of the cavities with the two universal base platforms. The system also includes a T-shaped panel that may be partially inserted into a universal base platform. Cushions may be installed or laid upon these T-shaped panels. Combinations of the universal base platforms, joining plates, T-shaped panels, and cushions may be assembled to create a variety of benches, couches, chaises, and sectionals, with or without arms.

25 Claims, 22 Drawing Sheets

(56) References Cited

U.S. PATENT DOCUMENTS

| | | | | |
|---|---|---|---|---|
| 6,378,539 | B1 | 4/2002 | Allee | |
| 6,796,614 | B1 | 9/2004 | Paul | |
| 8,132,371 | B2 * | 3/2012 | Golinski | F16B 12/44 52/36.5 |
| 8,528,972 | B2 * | 9/2013 | Johnsson | A47C 4/02 403/DIG. 1 |
| 8,550,015 | B2 * | 10/2013 | Wright | F16B 12/44 108/156 |
| 8,764,114 | B1 * | 7/2014 | Frank | A47C 7/42 297/440.16 |
| 9,532,651 | B2 | 1/2017 | Chung | |
| 11,378,117 | B1 | 7/2022 | Galjour | |
| 11,457,745 | B1 | 10/2022 | Clabots | |
| 11,517,115 | B2 * | 12/2022 | McCreary | A47C 13/005 |
| 11,659,934 | B2 | 5/2023 | Edmondson | |
| 11,930,930 | B1 * | 3/2024 | Zhao | A47C 7/546 |
| 2010/0024690 | A1 * | 2/2010 | Phillips | A47B 87/002 108/64 |
| 2013/0234576 | A1 * | 9/2013 | Hixson | A47B 47/0066 312/265.5 |
| 2014/0331903 | A1 * | 11/2014 | Massimini | A47B 13/088 108/64 |
| 2015/0351537 | A1 * | 12/2015 | Grabowski | F16B 12/52 24/303 |
| 2016/0206100 | A1 * | 7/2016 | Nelson | F16B 12/00 |
| 2020/0121090 | A1 * | 4/2020 | Romano | A47C 17/86 |
| 2021/0196049 | A1 * | 7/2021 | McCreary | A47C 17/04 |
| 2022/0000266 | A1 | 1/2022 | Nelson | |
| 2022/0354262 | A1 | 11/2022 | Kuhl | |
| 2023/0028655 | A1 | 1/2023 | Clabots | |
| 2024/0023715 | A1 * | 1/2024 | Chen | A47C 4/02 |
| 2024/0108145 | A1 * | 4/2024 | Armond | A47C 13/005 |
| 2024/0156270 | A1 * | 5/2024 | Wang | A47C 13/005 |
| 2024/0341487 | A1 * | 10/2024 | Checchin | A47C 1/124 |
| 2024/0358156 | A1 * | 10/2024 | Wu | A47C 7/546 |
| 2024/0415288 | A1 * | 12/2024 | Yuan | A47C 13/005 |
| 2024/0415290 | A1 * | 12/2024 | Aubé | A47C 13/005 |
| 2024/0418193 | A1 * | 12/2024 | Clabots | A47C 13/005 |
| 2024/0423374 | A1 * | 12/2024 | Nelson | A47C 1/0352 |
| 2025/0089901 | A1 * | 3/2025 | Oren | A47C 7/54 |

FOREIGN PATENT DOCUMENTS

| | | |
|---|---|---|
| EP | 3292793 | 3/2018 |
| JP | 2013094405 | 5/2013 |

OTHER PUBLICATIONS

ISR & WO for PCT/US23/79289 (May 2, 2024) (27 pages).
Clip Sofa, https://www.evanclabots.com/clip (accessed Sep. 26, 2023) 3 pages.
https://www.evanclabots.com/clip (2022) (3 pages).
Office Action (Non-Final Rejection) dated Sep. 23, 2025 for U.S. Appl. No. 18/738,825 (pp. 1-15).

* cited by examiner

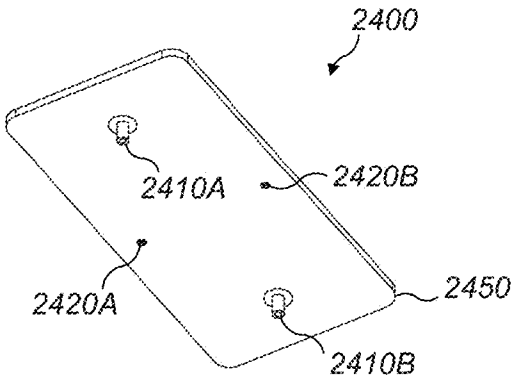
FIG. 24
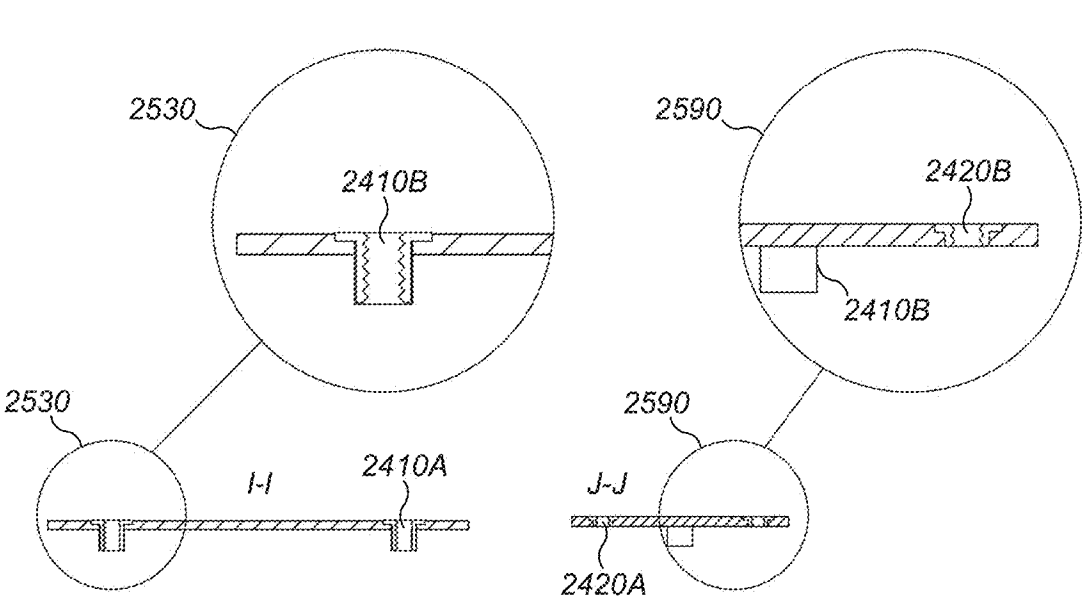
FIG. 25
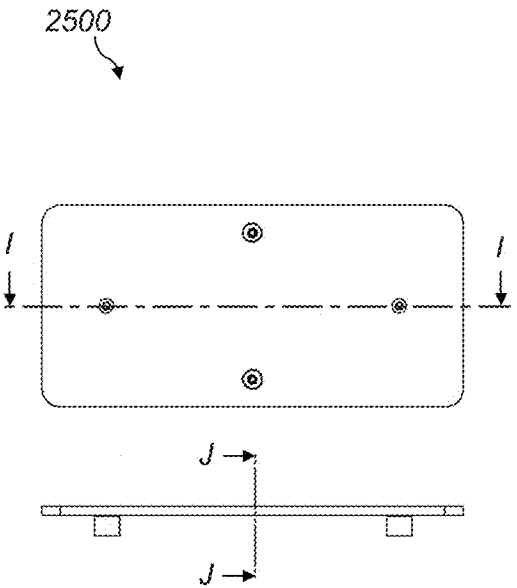

MODULAR LOUNGE SEATING ASSEMBLY SYSTEM

RELATED APPLICATION

This application claims the benefit of the following U.S. Provisional Patent Application, which is incorporated by reference in its entirety:

Ser. No. 63/383,148, filed on Nov. 10, 2022.

FIELD OF THE DISCLOSURE

This application is directed to various forms of modular furniture assembly, and in particular, modular couch assemblies that may be assembled in primarily in an upright position.

BACKGROUND

Conventional seating furniture are typically manufactured as a single frame either covered with padding and fabric and/or provided with cushions. The frame and cushions are then transported directly to the consumer, or to a retail outlet. The bulky nature of the furniture items results in significant transport and storage costs. Modular furniture, which is made of individual pieces that may be coupled together in different configurations, may reduce both transportation and storage costs. This is because when disassembled, the modular pieces may be transported or stored in a smaller space per furniture item.

Conventional modular furniture is often assembled as an individual chair and secured to adjacent chairs in a piecemeal fashion. In other words, adjacent modules that form an individual chair (a seat module and a backrest module, and in the case of the end chairs, an armrest module) are coupled to each other one at a time with fasteners. The individual chair is then coupled to each other to form a piece of furniture. This requires simultaneously aligning connectors on the seat and backrest modules with receivers on the adjacent seat and backrest modules. Simultaneously aligning multiple connectors may be difficult, especially when the connectors are on multiple modules. Furthermore, typically the last module to be attached is the legs or feet to an underside of the assembled piece of furniture, which requires flipping the entire piece of furniture on its side or back to attach the legs or feet to both adjacent modules.

SUMMARY

The modular lounge seating assembled system described herein allows for compatible modular further pieces that may be assembled into a variety of benches, couches, chaises, and sectionals, with or without arms. The system includes a universal base platform that has a cavity in the separation between an upper portion and a lower portion separated by spacers. A U-connector may be used instead of spacers. The universal base platform may optionally have a removable bottom cushion. Legs may be installed under one or more of the corners of the universal base platform. The universal base platform may also have pass-through holes in the center of its bottom frame.

Two universal base platforms may be joined by a joining plate that is partially inserted into each of the cavities with the two universal base platforms. The joining plate may be secured into two universal base platforms using threaded bolts through the pass-through holes in the universal base platform center bottom frames and the threaded holes in the joining plate. The joining plate may also receive legs to support the entire lounge seating assembly.

The system also includes a T-shaped panel that may be partially inserted into a universal base platform. The T-shaped panel may be secured to the universal base platform using a threaded bolt through the pass-through hole in the universal base platform center bottom frame and a threaded hole in the T-shaped panel. Cushions may be installed or laid upon these T-shaped panels.

Combinations of the universal base platforms, joining plates, T-shaped panels, and cushions may be assembled to create a variety of benches, couches, chaises, and sectionals, with or without arms.

Alternatively, if removable cushions are always used with the universal base platform, the universal base platform may have threaded holes instead of pass-through holes. Alternative joining plates and T-shaped panels may then have pass-through holes instead of threaded holes. In this alternative construction, threaded bolts may secure the joining plates and T-shaped panels to the universal base platforms from the top down. This means that the assembler conveniently need not overturn the modular couch pieces in order to join them together.

BRIEF DESCRIPTION OF THE DRAWINGS

The accompanying figures, where like reference numerals refer to identical or functionally similar elements throughout the separate views, together with the detailed description below, are incorporated in and form part of the specification, serve to further illustrate embodiments of concepts that include the claimed invention and explain various principles and advantages of those embodiments.

FIG. 24 shows a view of a joining plate.

FIG. 25 shows cross-section views of a joining plate.

Figure 1:
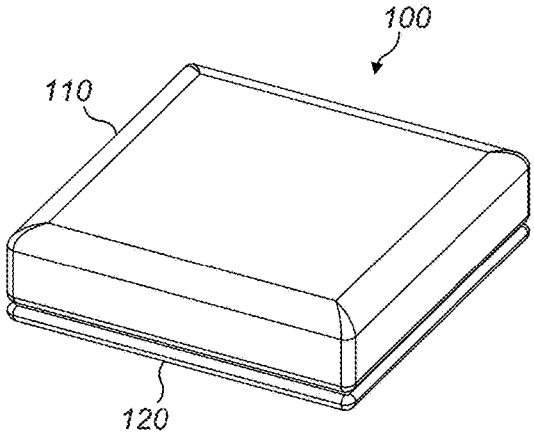
FIG. 1 shows a top view of a universal base platform.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

I. Modular Lounge Seating Assembly System

The following describes a system of parts used to create modular lounge seating that accomplishes the following goals:

- Allows for the connection of multiple seating modules in multiple configurations;
- Easy set up and reconfiguration by one person;
- Easily remove and add back and arm panels while seat remains in upright position;
- Allows connected modules to share support legs;
- Allows for the attachment of multiple back and arm styles; and
- Allows for a wide variety of seating configurations including armless and backless styles.

This system of parts include a universal base platform having a cavity and connection holes, legs, joining plates, T-shaped panels, and cushions.

A. Universal Base Platform

The universal base platform serves as the seating cushion for the modular lounge seating assembly system. The construction of the universal base platform includes an internal cavity whereby other pieces may be inserted and secured to build the lounge seating assembly.

Figure 2:
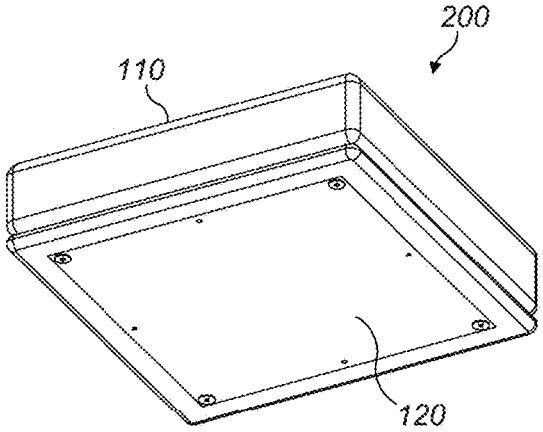
FIG. 2 shows a bottom view of a universal base platform.
Figure 3:
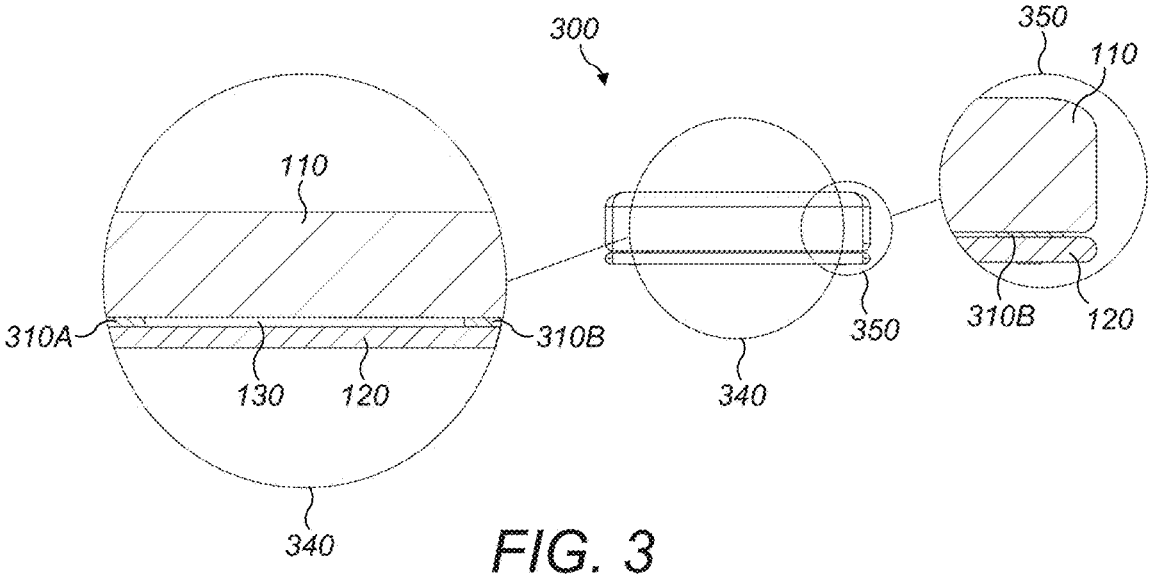
FIG. 3 shows views of a cavity in a universal base platform.

Turning to FIG. 1, shown is a top view 100 of universal base having a base top 110 and base bottom 120. Turning to FIG. 2, shown is a bottom view 200 of a universal base having a base top 110 and base bottom 120. Turning to FIG. 3, shown is a side cross-section view 300 of the universal base. As shown in inset circles 340 and 350, there is an internal cavity 130 between the base top 110 and the base bottom 120. A series of spacers 310A 310B separate the base top 110 and the base bottom 120 to create the internal cavity 130.

Figure 4:
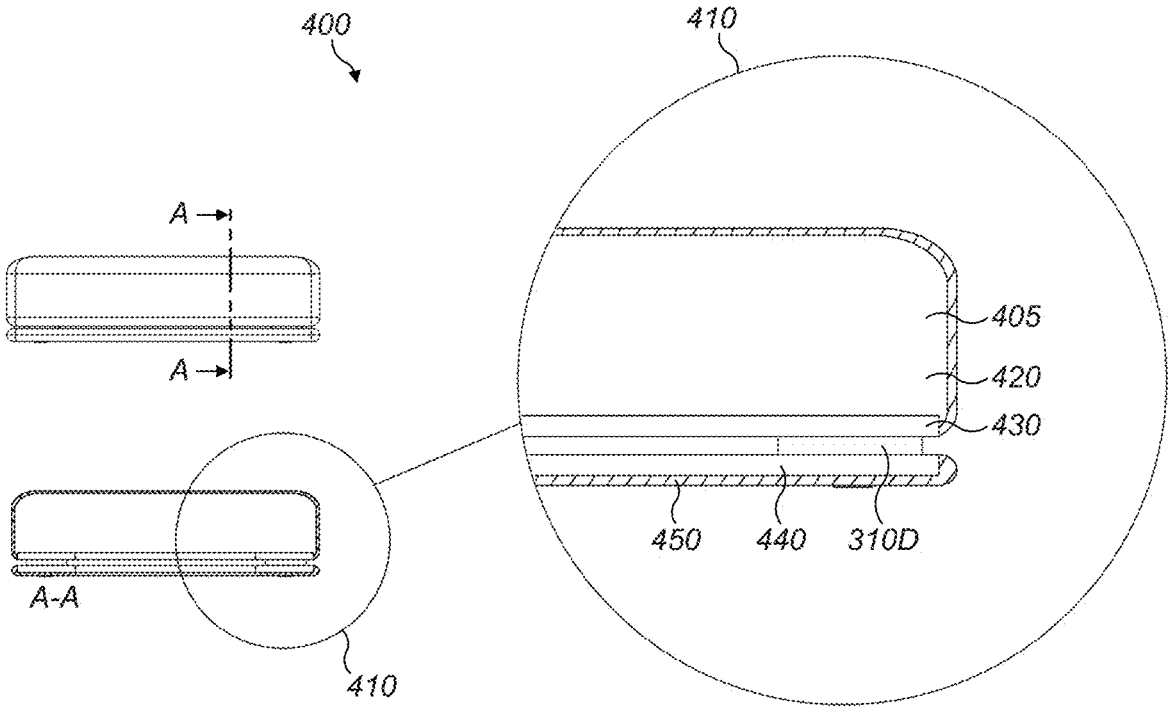
FIG. 4 shows a cross-section view of a universal base platform.

Turning to FIG. 4, shown is cross section A-A view 400 illustrating further detail of the universal base. As shown in inset circle 410 for the A-A view, the top portion of the universal base includes fabric 405 and foam 420 surrounding the frame 430. The bottom portion of the universal base includes fabric 450 surrounding the frame 440, The spacer 310D separates the top portion and bottom portion of the universal base.

As shown by FIGS. 1, 2, 3, and 4, the universal base is made up of two platforms (A and B) fixed together and separated by spacers. This creates an open internal cavity on all sides of the universal base as defined by Platform A on the top, Platform B on the bottom, and spacers on the sides or corners of the cavity.

Figure 5:
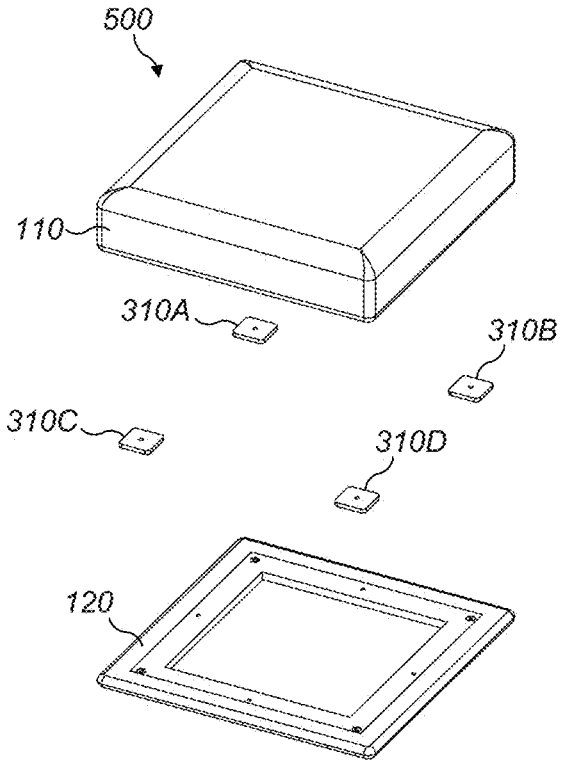
FIG. 5 shows an exploded view of a universal base platform.

Turning to FIG. 5, shown is an exploded view 500 of the universal base. The base top 110 is set upon the base bottom 120 with spacers 310A 310B 310C 310D sandwiched in between.

Figure 6:
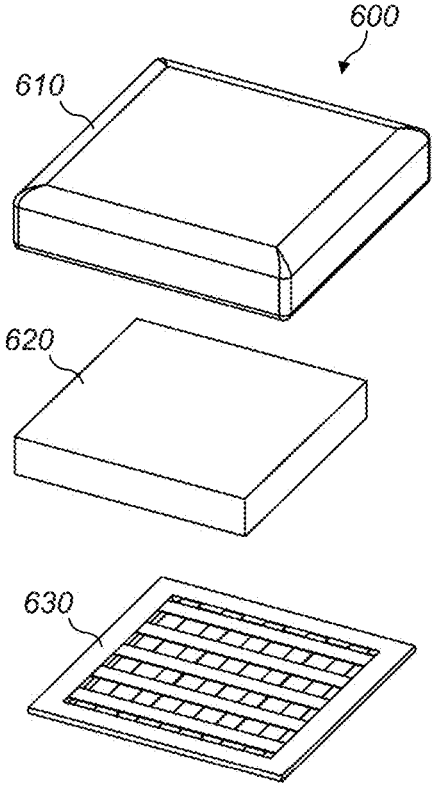
FIG. 6 shows a further exploded view of a universal base platform.

Turning to FIG. 6, shown is an exploded view 600 of an alternate universal base. The base top 610 overlays foam 620 and is attached to a bottom frame 630.

Figure 7:
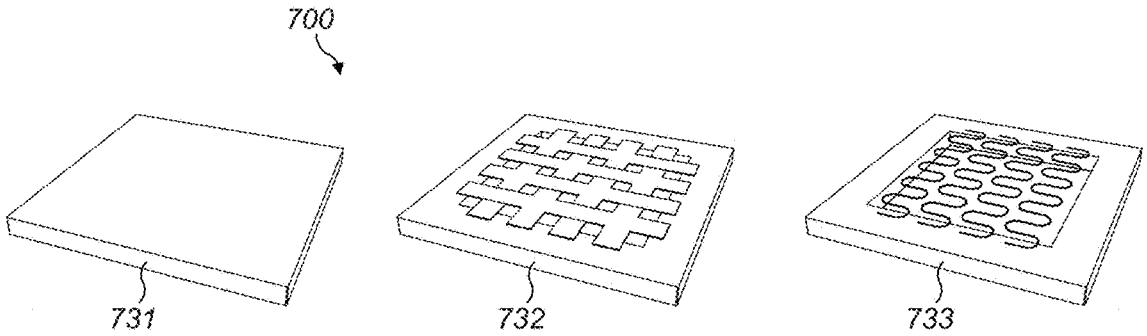
FIG. 7 shows various platform view of a universal base platform.

Turning to FIG. 7, shown are alternative views 700 of platforms for the universal base. The views include solid panel 731, webbing 732, or sinuous springs 733.

As shown in FIGS. 4, 5, and 6, platform A may have a hard frame around the bottom perimeter on the panel. The center of the platform A frame may be made of various constructions including but not limited to a solid panel, webbing, or sinuous springs, as in FIG. 7. Additionally, platform A may include foam where the frame and foam are upholstered together with fabric, as in FIGS. 4 and 6. Platform B may consist of a hard frame upholstered with fabric, as in FIG. 4. The spacers separate and connect platform A and platform B may also be of a hard material, as in FIGS. 4 and 5.

Figure 8A:
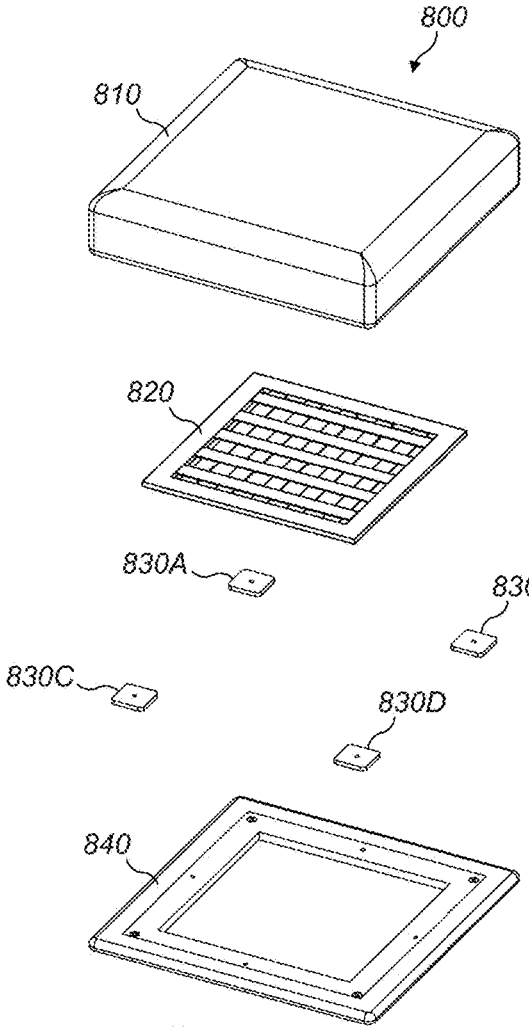
FIGS. 8A and 8B show further exploded views of a universal base platform.
Figure 8B:
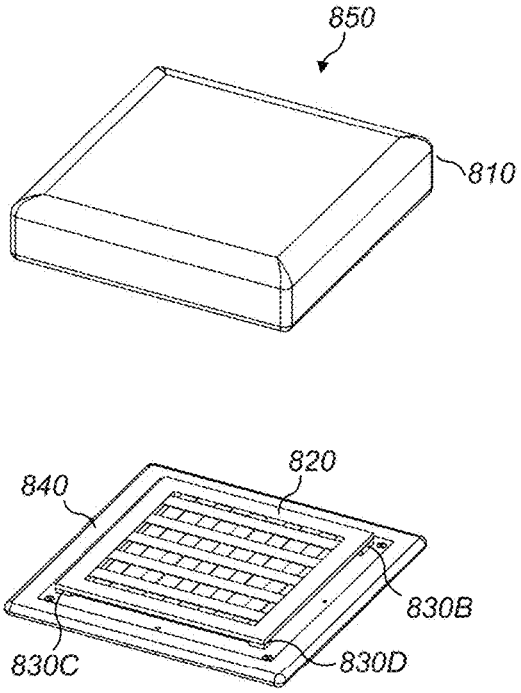

Turning to FIGS. 8A and 8B, shown are exploded views 800 850 of an alternative universal base. This alternative includes a removable base top 810 set over a platform 820. This platform 820 is independently attached to a base bottom 840. Spacers 830A 830B 830C 830D separate the platform 820 from the base bottom 840.

Figure 9:
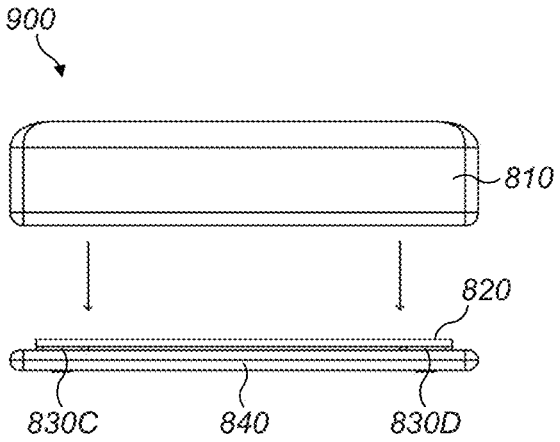
FIG. 9 shows a view of a cushion and a universal base platform.

Turning to FIG. 9, shown is a side view 900 illustrating the assembly of a removable cushion and universal base platform. The removable base top 810 is placed over the platform 820 that is independently attached to the base bottom 840. Spacers 830C 830D separate the platform 820 and the base bottom 840.

Figure 10:
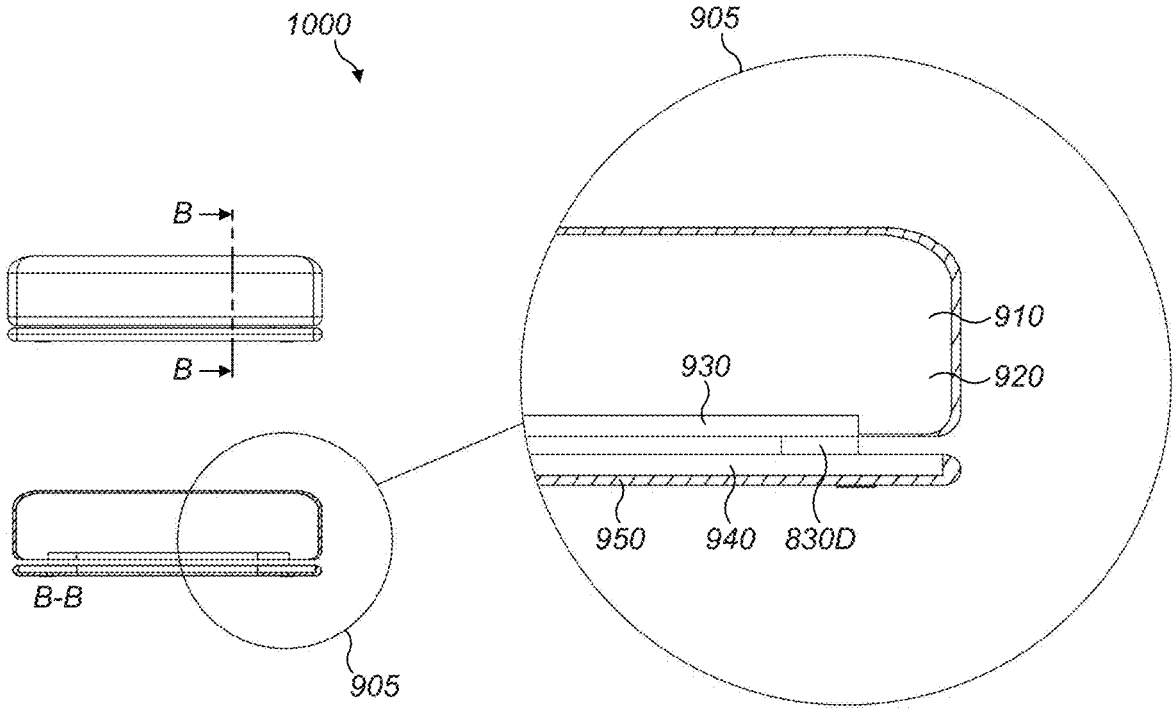
FIG. 10 shows a further cross-section view of a universal base platform.

Turning to FIG. 10, shown is a cross-section B-B view 1000 of an assembled universal base platform with a removable cushion. As shown in inset circle 905 for the B-B view, the top portion of the removable cushion includes fabric 910 and foam 920 surrounding the top platform 930. The fabric 910 and foam 920 are removable from the assembly. The bottom portion of the universal base includes fabric 950 surrounding the bottom platform 940, The spacer 830D separates the top platform 930 and bottom platform 940.

As shown in FIGS. 8A, 8B, 9, and 10, the universal base may alternatively be constructed with a removable cushion, In this case, the removable cushion is set on top of an independently positioned platform A. The removable cushion has a cavity in the bottom so that when the cushion is set on top of the universal base (as in FIG. 9), the edges of the cushion sit alongside of the platform A frame and conceal it (as in FIG. 10). As before, the spacers separate and connect platform A and platform B, and may be of a hard material.

Figure 11:
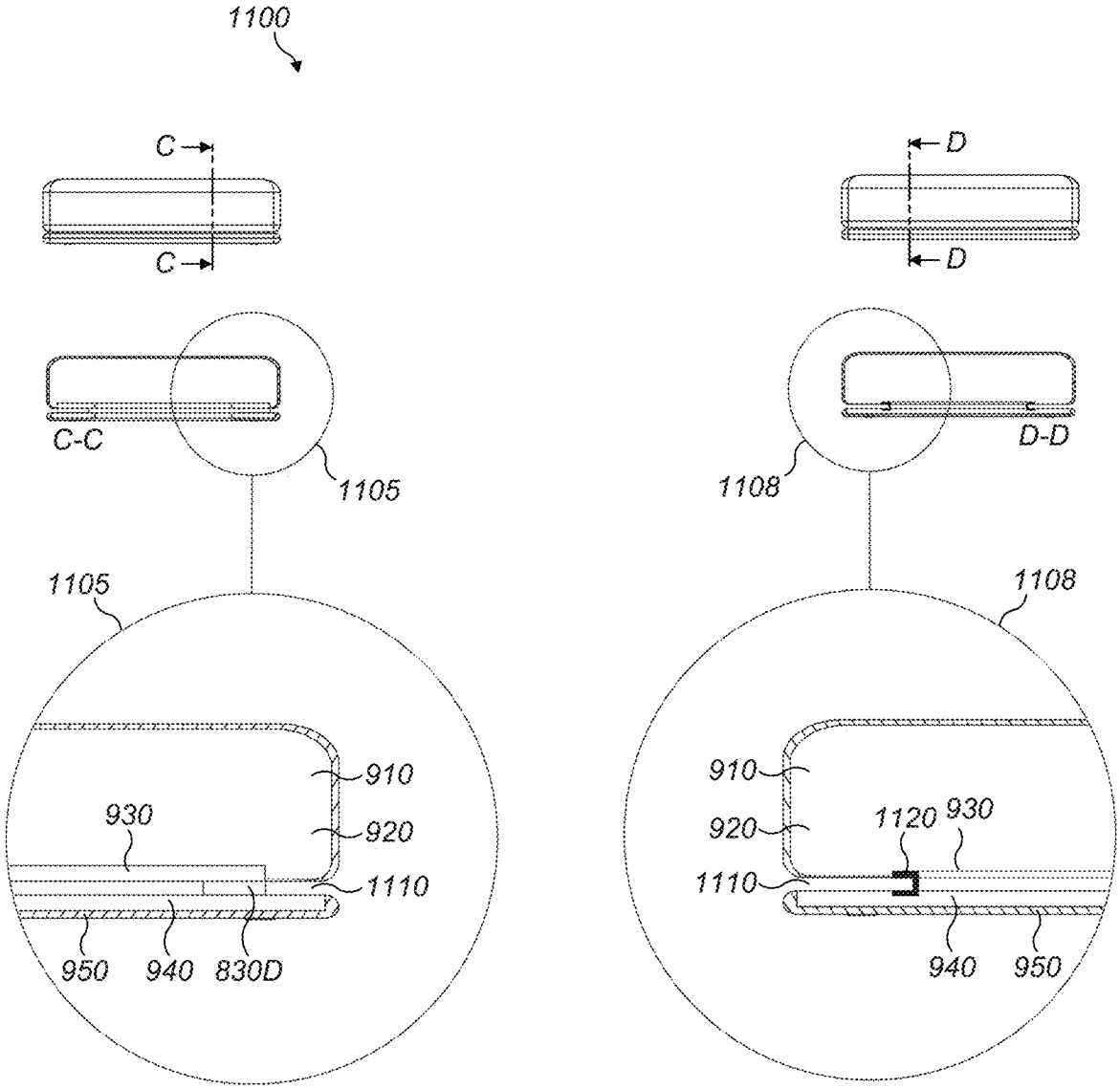
FIG. 11 shows further cross-section views of a universal base platform.

Turning to FIG. 11, shown are cross-section C-C and D-D views 1100 of alternate constructions of an assembled universal base platform. As shown in inset circle 1105 for the C-C view, the top portion of the universal base includes fabric 910 and foam 920 surrounding the frame 930. The bottom portion of the universal base includes fabric 950 surrounding the frame 940, The spacer 830D separates the top portion and bottom portion of the universal base such that a cavity 1110 is formed. As shown in inset circle 1108 for the D-D view, the top portion of the universal base includes fabric 910 and foam 920 surrounding frame 930. The bottom portion of the universal base includes fabric 950 surrounding the frame 940, A U-channel 1120 separates the top portion and bottom portion of the universal base within the cavity 1110 formed.

FIG. 11 shows an alternate construction a universal base where the cavity achieved by the fastening of platform A to platform B with spacers may also be achieved with an extrusion of a U-channel. This may or may not be used with a removable cushion.

Figure 12:
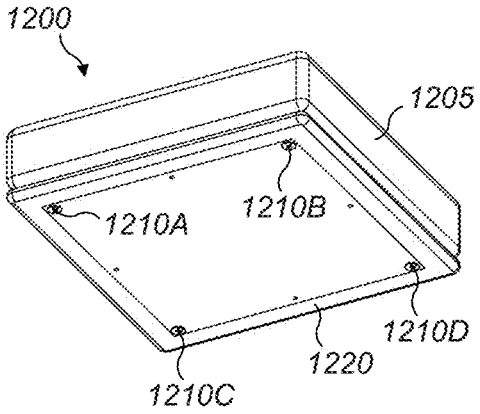
FIG. 12 shows a further bottom view of a universal base platform.
Figure 13:
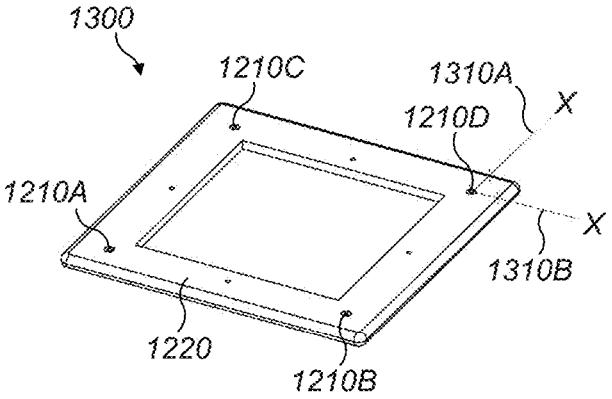
FIG. 13 shows a view of a frame for a universal base platform.

Turning to FIG. 12, shown is a bottom perspective view 1200 of the universal base platform. Shown is a top 1205 attached to a frame 1220 having leg connection holes 1210A 1210B 1210C 1210D. Turning to FIG. 13, shown is a top perspective view 1300 of the frame 1220 and leg connection holes 1210A 1210B 1210C 1210D. The distance of a representative leg connection hole 1210D to the edge of the frame 1220 may be same, as shown by the X distance 1310A 1310B.

Figure 14:
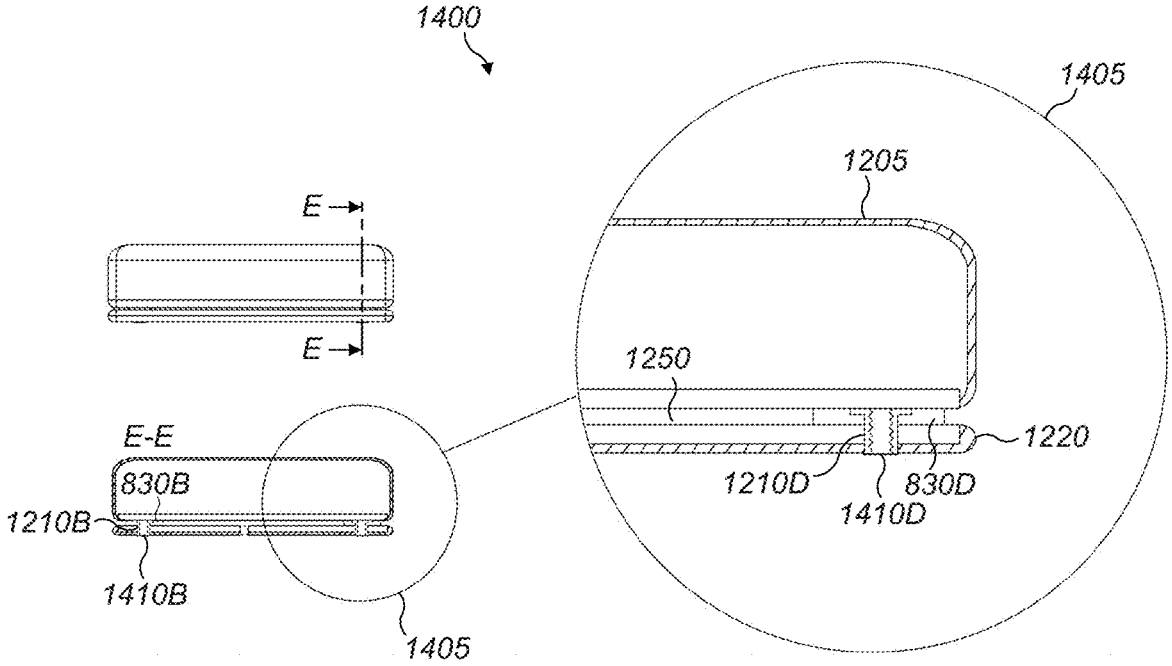
FIG. 14 shows a further cross-section view of a universal base platform.

Turning to FIG. 14, shown is a cross-section E-E view 1400 of a universal base platform with leg connection holes at the corners. Shown is a leg connection hole 1210B with a threaded insert 1410B that also cuts through spacer 830B. In the inset circle 1405, shown is a top 1205 that is attached to the frame 1220 forming a cavity 1250. The threaded insert 1410D is shown as part of the leg connection hole 1210D that also cuts through spacer 830D.

Figure 15:
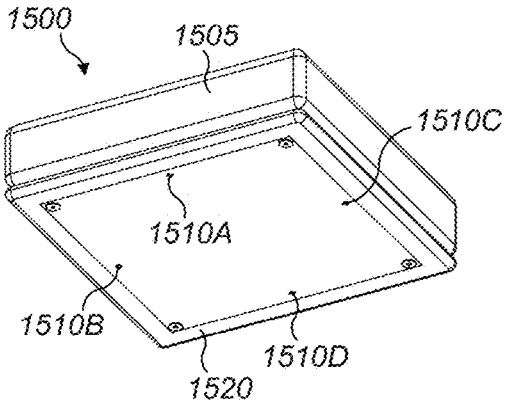
FIG. 15 shows a further bottom view of a universal base platform.
Figure 16:
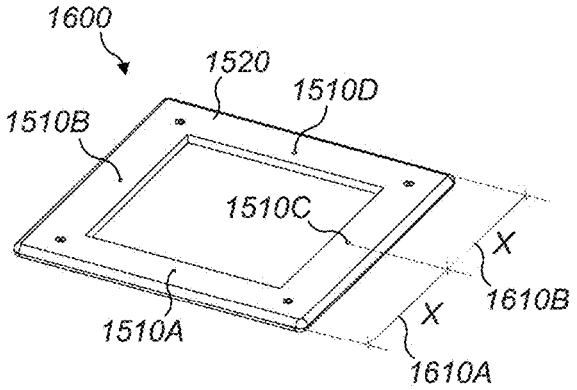
FIG. 16 shows a further view of a frame for a universal base platform.

Turning to FIG. 15, shown is a bottom perspective view 1500 of the universal base platform. Shown is a top 1505 attached to a frame 1520 having pass-through holes 1510A 1510B 1510C 1510D. Turning to FIG. 16, shown is a top perspective view 1600 of the platform 1520 having pass-through holes 1510A 1510B 1510C 1510D. The distance of a representative leg connection hole 1510C to the edge of the platform 1520 may be same, as shown by the X distance 1610A 1610B.

Figure 17:
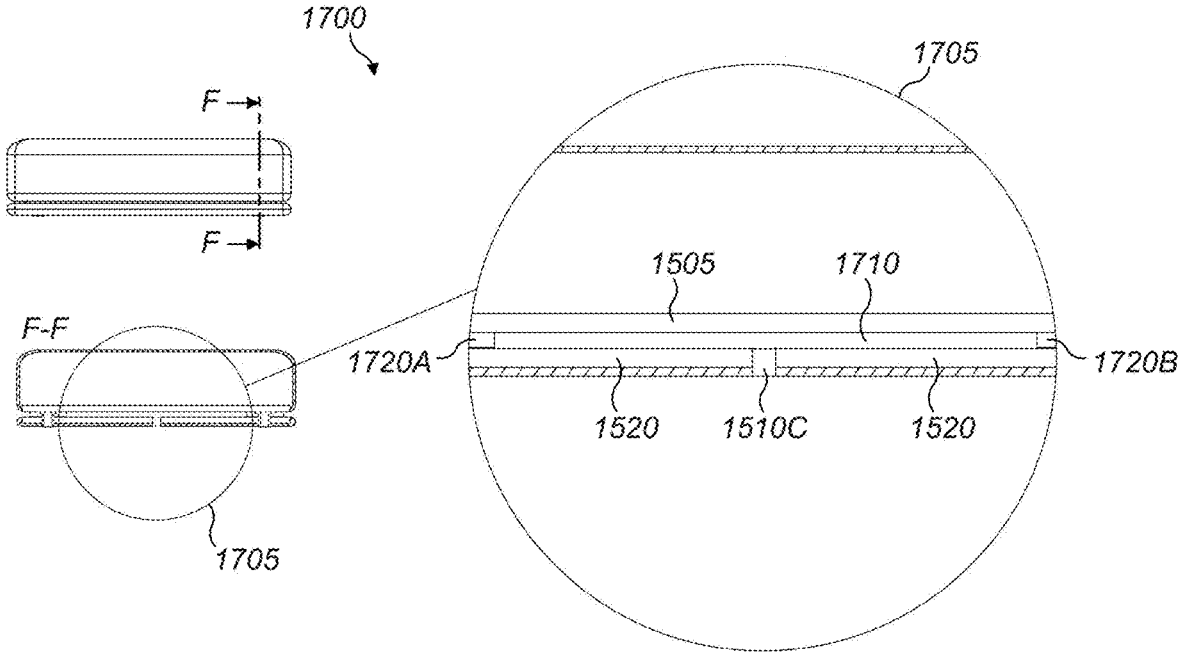
FIG. 17 shows a further cross-section view of a universal base platform.

Turning to FIG. 17, shown is a side cross-section F-F view 1700 of a universal base platform with pass-through holes in the center of each side. In the inset circle 1705, shown are spacers 1720A 1720B between the top frame 1505 and the platform 1520 creating an open cavity 1710. The pass-through hole 1510C is shown in the center of the F-F cross section.

Figure 18:
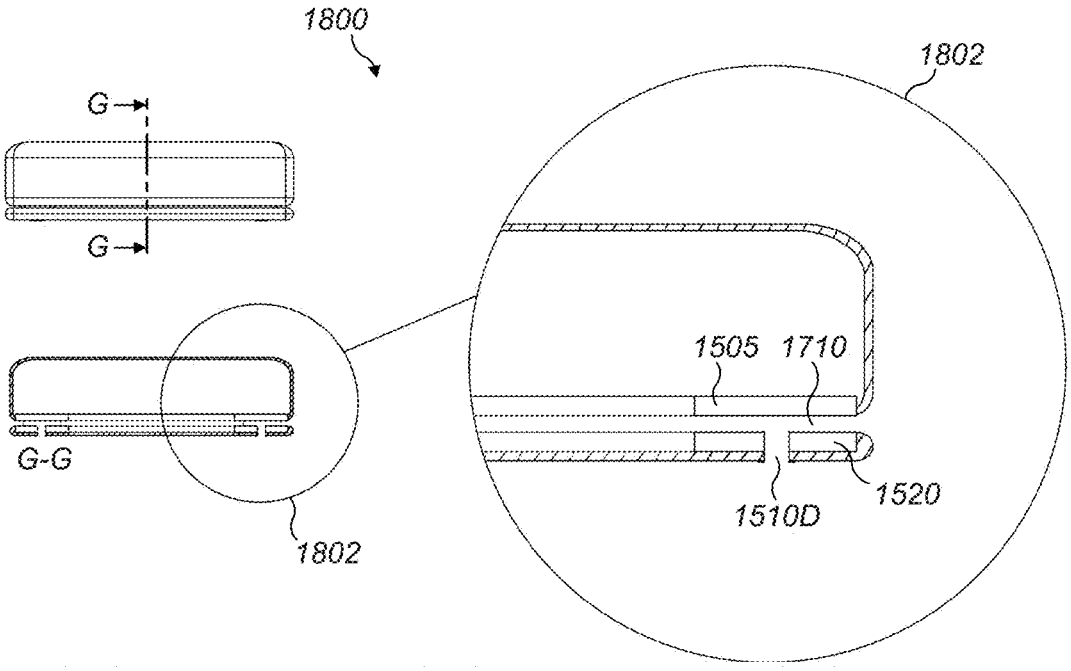
FIG. 18 shows a further cross-section view of a universal base platform.

Turning to FIG. 18, shown is a side cross-section G-G view 1800 of a universal base platform with pass-through holes in the center of each side. In the inset circle 1802, shown is the top frame 1505 and the platform 1520 creating an open cavity 1710. The pass-through hole 1510D is shown on the right side of the G-G cross section.

Thus, the universal base leg connection holes are located on the bottom side of platform B in each of the 4 corner, as in FIG. 12. They are an equal distance from the edge of the frame in both directions, as in FIG. 13. Each leg connection hole has a threaded insert into which a leg with a threaded rod can be attached, as in FIG. 14.

The universal base platform B also has pass-through holes on the bottom centers, as in FIG. 15. One pass-through hole or a cluster of pass-through holes are located along each side, centered down the length of the frame, as in FIG. 16. Such pass-through holes only pass through platform B and allow for a threaded bolt to pass though platform B and enter the cavity between platform A and platform B, as in FIGS. 17 and 18. Other portions of the modular couch assembly system described below may be inserted into the cavity to be secured therein by the threaded bolt.

B. Legs

Figure 19:
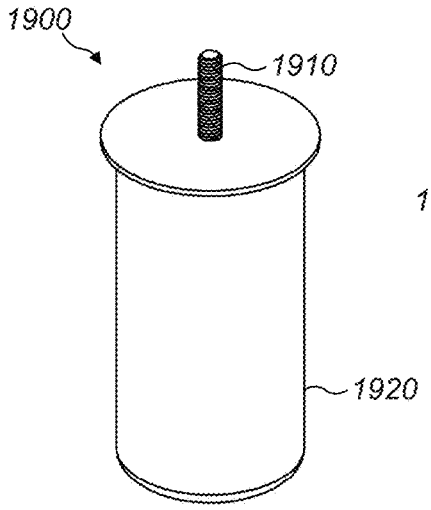
FIG. 19 shows a view of a leg in a universal base platform.

Turning to FIG. 19, shown is schematic view 1900 of a leg made of a hard material 1920 and a threaded rod 1910. Although the shape of the leg is shown as cylindrical, any shape or height of a leg may be used.

Figure 20:
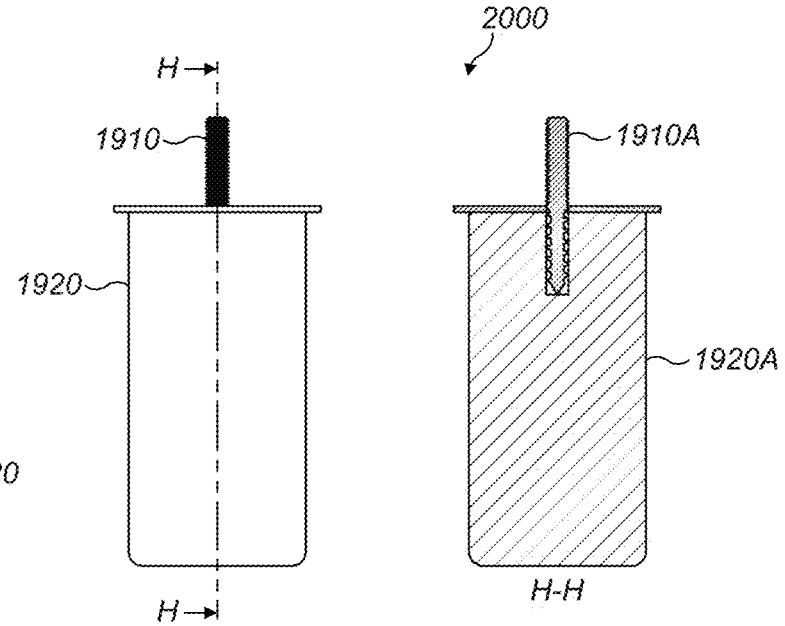
FIG. 20 shows a cross-section view of a leg in a universal base platform.

Turning to FIG. 20, shown is a side cross-section H-H view 2000 of the hard material 1920 and a threaded rod 1910. Also shown is the cross section of the hard material 1920A and the threaded rod 1910A.

Figure 21:
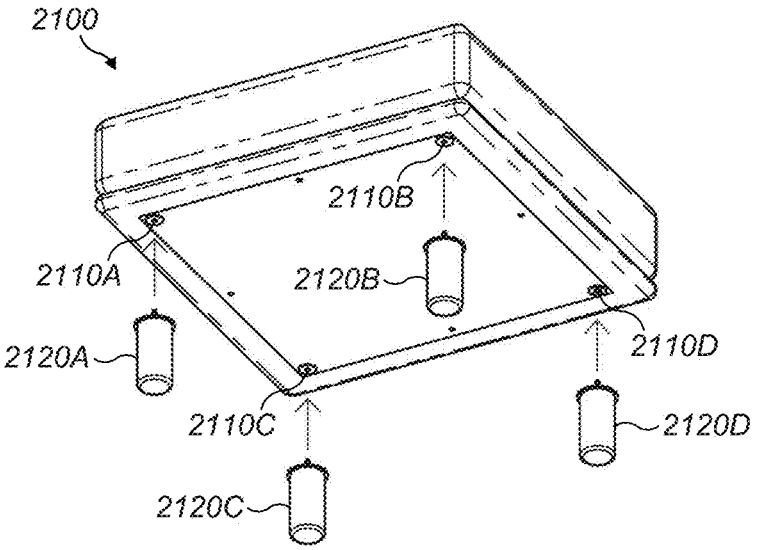
FIG. 21 shows legs being attached to the bottom of a universal base platform.

Turning to FIG. 21, shown is a schematic view 2100 whereby legs 2120A, 2120B, 2120C, 2120D are respectively screwed into leg connection points 2110A, 2110B, 2110C, 2110D.

Figure 22:
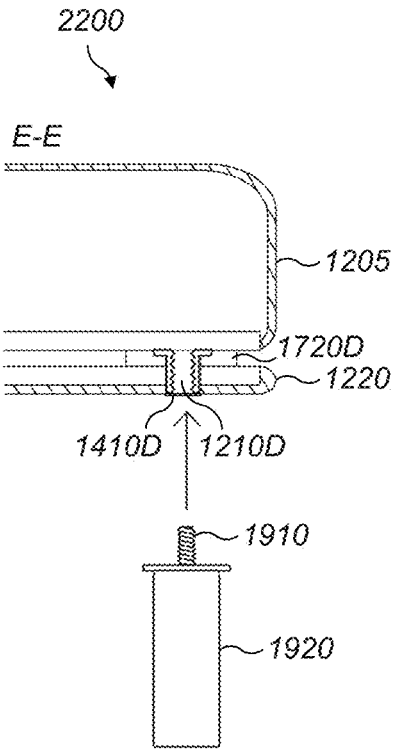
FIG. 22 shows a further cross-section view of a universal base platform.

Turning to FIG. 22, shown is a cross-section E-E view (referenced in FIG. 14) where a leg with hard material 1920 and a threaded rod 1910 is about to be screwed into a threaded insert 1410D through leg connection hole 1210D and the spacer 1720D. Also shown is the top frame 1205 and the bottom frame 1220.

Figure 23:
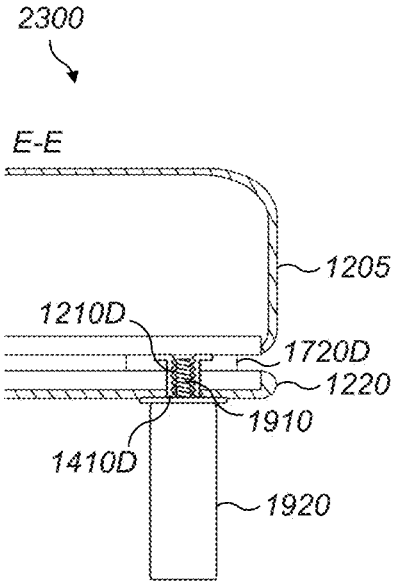
FIG. 23 shows a further cross-section view of a universal base platform.

Turning to FIG. 23, shown is a cross-section E-E view (referenced in FIG. 14) where a leg with hard material 1920 and a threaded rod 1910 has been screwed into the threaded insert 1410D through leg connection hole 1210D and the spacer 1720D. Also shown is the top frame 1205 and the bottom frame 1220.

Thus, the leg is made of a hard material and has a threaded rod protruding from the top, centered on the top face, as in FIGS. 19 and 20. The threaded rod of the leg may be inserted into any of the leg connection points, as in FIGS. 21 and 22, and screwed tight to the universal base, as in FIG. 23.

C. Joining Plate

Turning to FIG. 24, shown is a schematic view 2400 of joining plate 2450 that may be rectangular in shape. The joining plate 2450 includes four threaded hardware components, two threaded platform connection points 2420A 2420B and two joining plate leg connection tubes 2410A 2410B that have thread tubes protruding from them in one direction.

Turning to FIG. 25, shown are cross-section I-I and J-J views 2500. The I-I view shows cross sections of two joining plate leg connection tubes 2410A 2410B that have thread tubes protruding from them in one direction. The inset circle 2530 shows further detail of the cross section of one joining plate leg connection tube 2410B. The J-J view shows cross sections of two threaded platform connection points 2420A 2420B. The inset circle 2590 shows further detail of the cross section of one threaded platform connection points 2420A and the edge of the joining plate leg connection tube 2410B.

The joining plate may be used to connect two couch sections by taking advantage of the cavities within the couch sections.

Figure 26A:
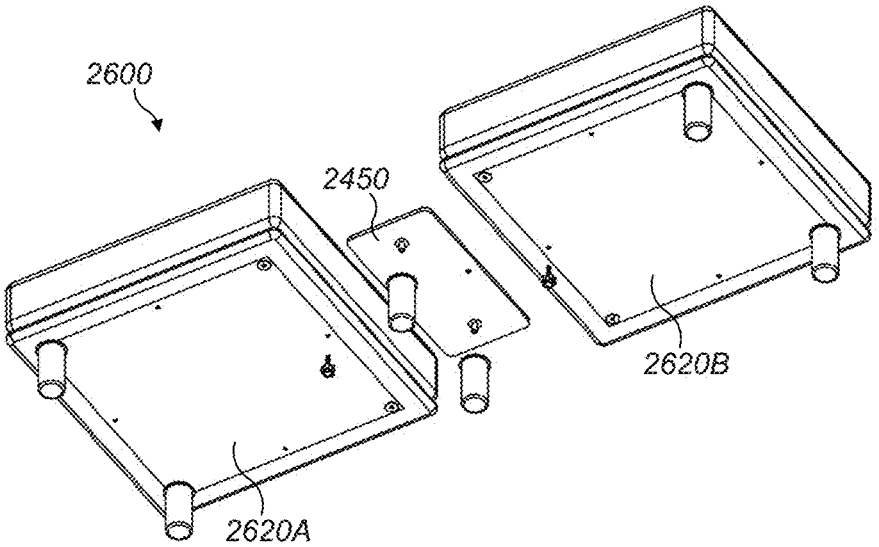
FIGS. 26A and 26B show views of a joining plate with universal base platforms.

Turning to FIG. 26A shown is a schematic overview 2600 of a joining plate 2450 connecting a first couch section 2620A with a second couch section 2620B.

Figure 26B:
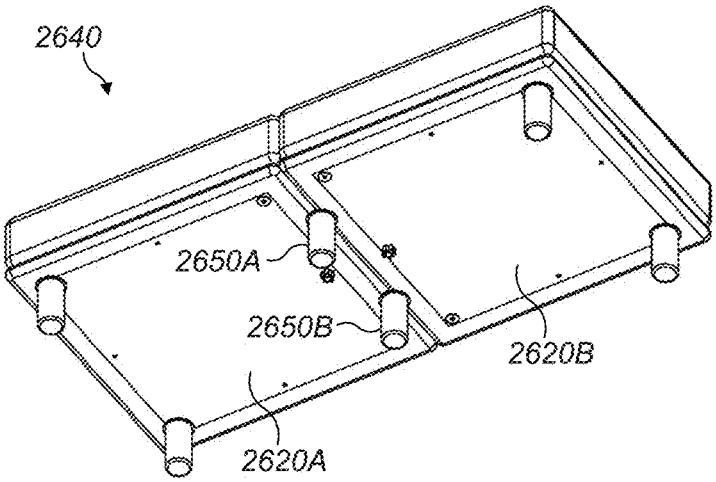

Turning to FIG. 26B shown is a schematic overview 2640 of a joining plate (not shown) connecting a first couch section 2620A with a second couch section 2620B via first leg 2650A and second leg 2650B that are screwed into the joining plate 2450.

Figure 27:
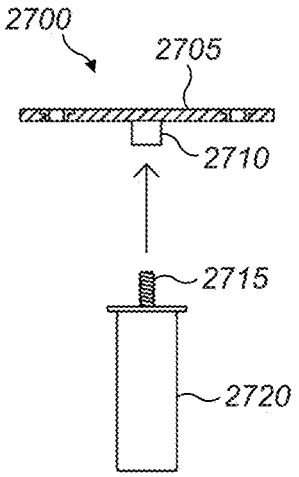
FIG. 27 shows a cross-section view of a leg being attached to a joining plate.

Turing to FIG. 27, shown is a side cross-section view 2700 of a leg 2720 being screwed into the joining plate 2705. The leg 2720 with a threaded rod 2715 is capable of being screwed into joining plate leg connection tube 2710 attached to joining plate 2705. A second leg (not shown) may also be screwed into a second joining plate leg connection tube (not shown) directly behind the leg 2710 into the same joining plate 2705. (This second leg (not shown) may also be present in FIGS. 28, 29, 30, 31, and 32.)

Figure 28:
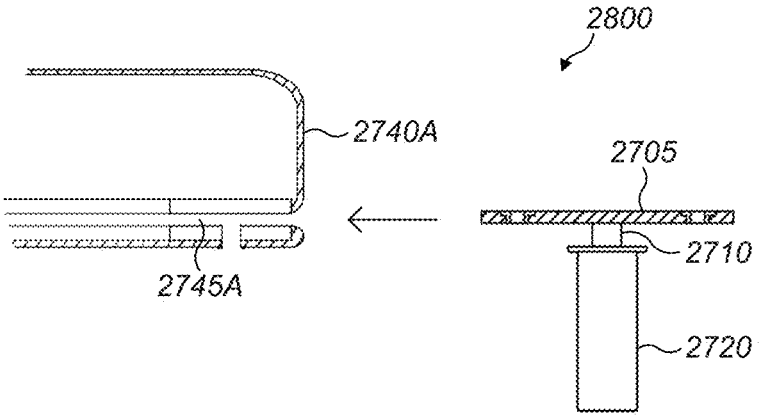
FIG. 28 shows a cross-section view of a leg attached to a joining plate being attached to a universal base platform.

Turning to FIG. 28, shown is a cross-section view 2800 of a joining plate 2705 with a leg 2720 attached being inserted into a first couch section. Shown is a leg 2720 whose threaded rod (not shown) is screwed into joining plate leg connection tube 2710 attached to joining plate 2705. This mechanism is inserted into the cavity 2745A of a first couch section 2740A.

Figure 29:
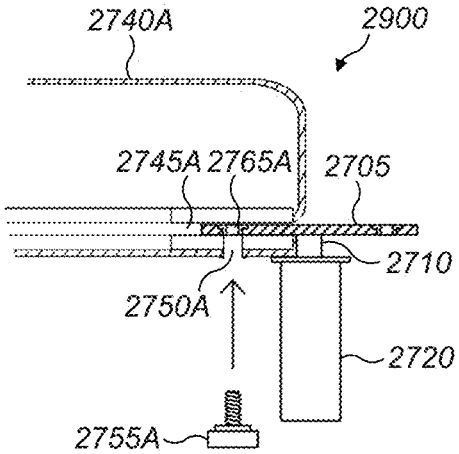
FIG. 29 shows a further cross-section view of a leg attached to a joining plate being attached to a universal base platform.

Turning to FIG. 29, shown is a cross-section view 2900 of a joining plate with a leg attached being secured into a first couch section. Shown is a leg 2720 whose threaded rod (not shown) is screwed into joining plate leg connection tube 2710 attached to joining plate 2705. This mechanism is inserted into the cavity 2745A of a first couch section 2740A, and then secured via a first threaded bolt 2755A through a pass-through hole 2750A and into the joining plate threaded hole 2765A.

Figure 30:
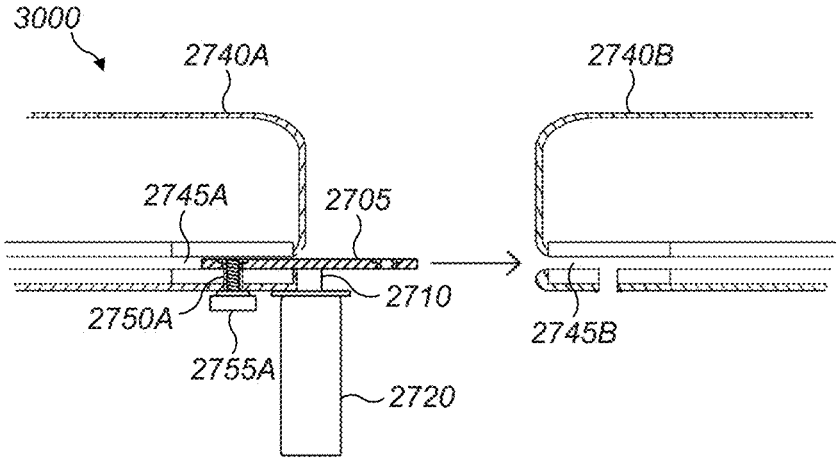
FIG. 30 shows a cross-section view of a joining plate being attached to two universal base platforms.
Figure 31:
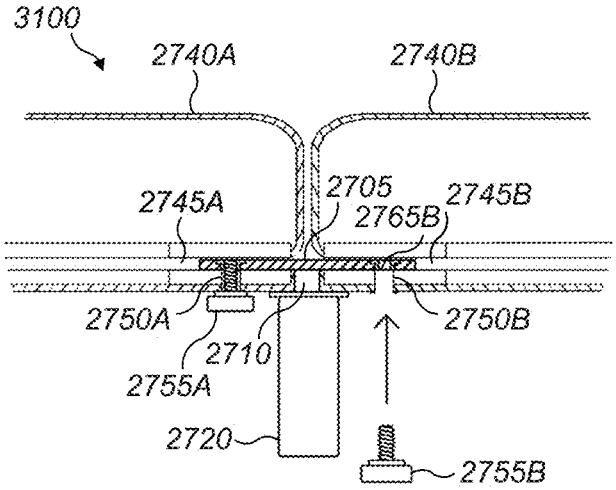
FIG. 31 shows a further cross-section view of a joining plate being attached to two universal base platforms.
Figure 32:
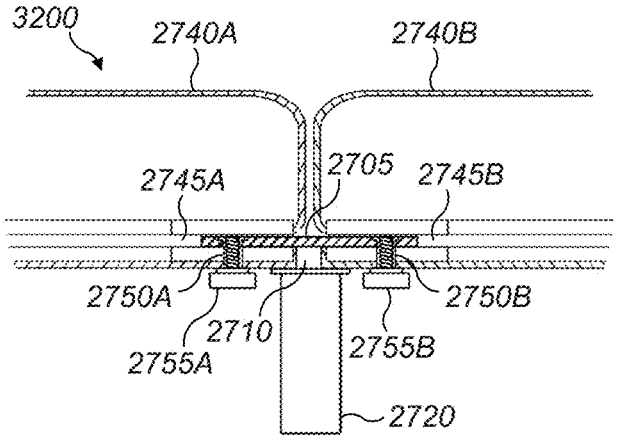
FIG. 32 shows a further cross-section view of a joining plate being attached to two universal base platforms.

Turning to FIGS. 30, 31, 32, shown are cross-section views 3000 3100 3200 of a joining plate with a leg attached and secured to a first couch section being inserted and secured into a second couch section. Shown is a leg 2720 whose threaded rod (not shown) is screwed into joining plate leg connection tube 2710 attached to joining plate 2705. This mechanism is inserted into the cavity 2745A of a first couch section 2740A, and then secured via a first threaded bolt 2755A through a pass-through hole 2750A and into the joining plate threaded hole 2765A (not labeled). The joining plate 2705 is then inserted into the cavity 2745B of a second couch section 2740B, and then secured via a second threaded bolt 2755B through a pass-through hole 2750B and into the joining plate threaded hole 2765B. The pass-through holes 2705A 2750B may be the pass-through holes described above in connection with FIGS. 15, 16, 17, and 18.

Thus, a joining plate is made of a flat hard material and is rectangular in shape. It is equipped with four threaded hardware components, two threaded platform connection points and two joining plate leg connection tubes, as in FIG. 24. The threaded platform connection points are holes located mid-way along the long edge of the joining plate that each contain threaded inserts embedded within the thickness of the joining plate, as in FIG. 25. The joining plate leg connection tubes are holes located mid-way along the short edge of the joining plate, which have thread tubes protruding from them in one direction, as in FIG. 25. The joining plate may be used to join two universal base platforms together and allow for the attachment of a single set of legs to support both universal bases at that connection point, as in FIGS. 26, 27, 28, 29, 30, 31, and 32.

D. T-Shaped Panel

Figure 33:
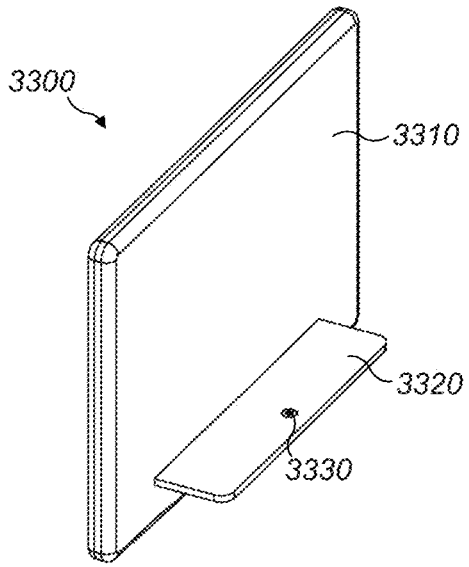
FIG. 33 shows a view of a T-shaped panel.

Turning to FIG. 33, shown is a schematic view 3300 of a T-shaped panel consisting of a vertical surface 3310 and a horizontal surface 3320 connected with a side of the vertical surface 3310 forming a sideways asymmetrical T. The horizontal surface includes a hole 3330 with threaded inserts embedded within the thickness to receive a bolt.

Figure 34:
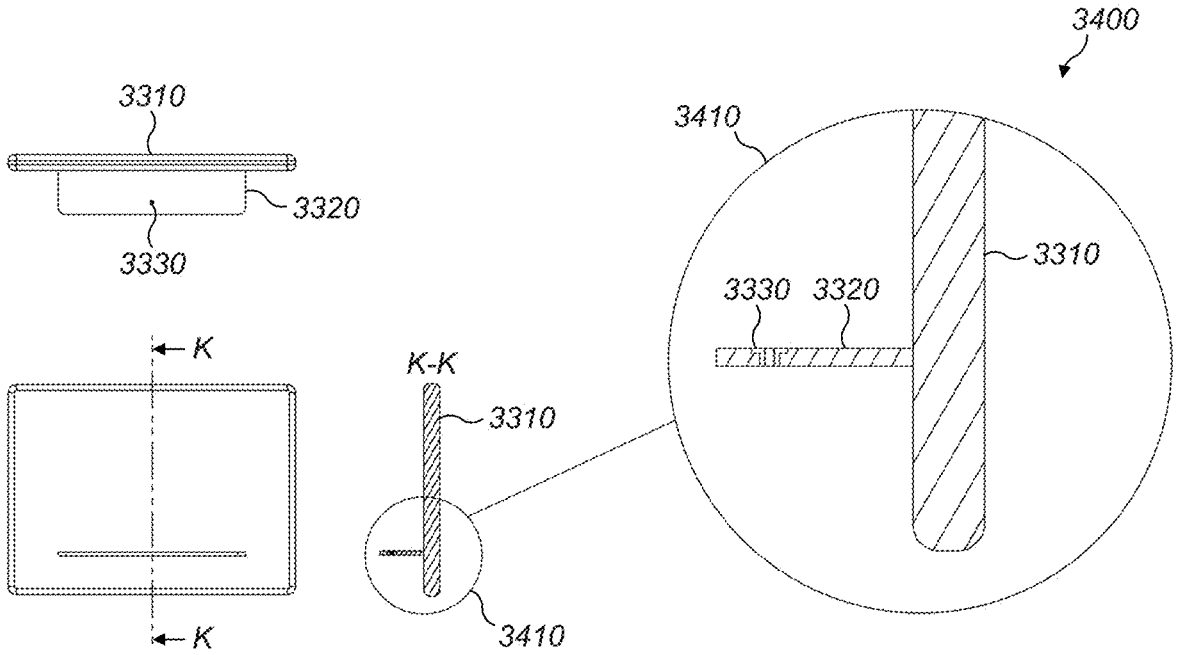
FIG. 34 shows cross-section views of a T-shaped panel.

Turning to FIG. 34, shown is a cross-section K-K view 3400 of the T-shaped panel. In the inset circle 3410 shown is a cross-section of the vertical section 3310 and the horizontal section 3320 having a threaded hole 3330.

Thus, the T-shaped panel has a vertical and horizontal surface with the vertical surface being taller than the horizontal surface is wide. The horizontal surface connects with the side of the vertical surface in a perpendicular manner, forming a sideways asymmetrical T, as in FIG. 33. Note that the horizontal surface 3320 does not extend the entire length of the vertical surface 3330. As will be demonstrated, this construction allows legs to be separately attached to universal base platforms without interfering with the inserting and securing of the T-shaped panel into the cavities of the same universal base platforms. The T-shaped panel has one hole or a cluster of holes in the horizontal surface, and the hole or holes have a threaded inserts embedded within the thickness to receive a bolt, as in FIG. 34.

Figure 35:
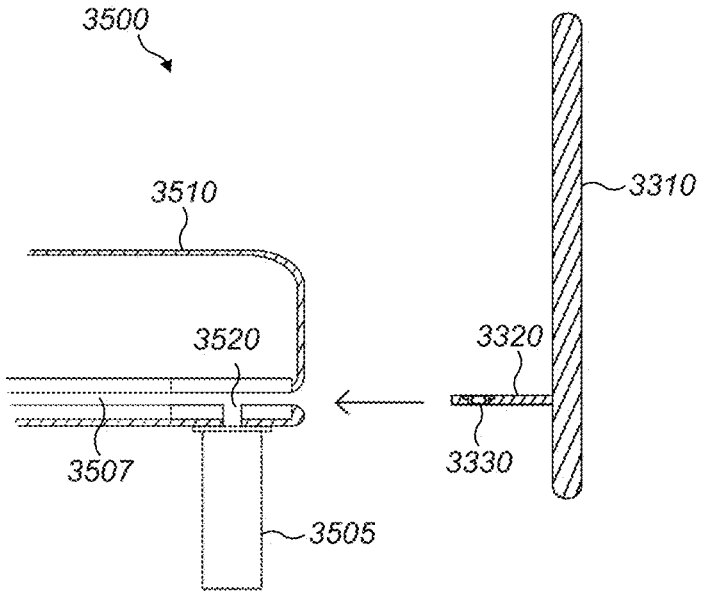
FIG. 35 shows a cross-section view of a T-shaped panel being inserted into a universal base platform.

Turning to FIG. 35, shown is a cross-section view 3500 of the T-shaped panel about to be inserted into a cavity of a universal base. Shown is a universal base 3510 having a cavity 3507, a pass-through hole 3520, and—in the background—an attached leg 3505 inserted into the universal base 3510. The T-shaped panel having a long vertical section 3310 and short horizontal section 3320 with a threaded hole 3330 is about to be inserted into the cavity 3507. The pass-through hole 3520 may be the pass-through hole described above in connection with FIGS. 15, 16, 17, and 18. The leg 3505 is attached to the universal base 3510 behind the hole 3520 through another hole (not shown). Because the horizontal surface 3320 does not extend the entire length of the vertical surface 3330 (as in FIG. 33), the leg 3505 may be so attached without interfering with the insertion of the horizontal surface 3320 into the cavity 3507.

Figure 36:
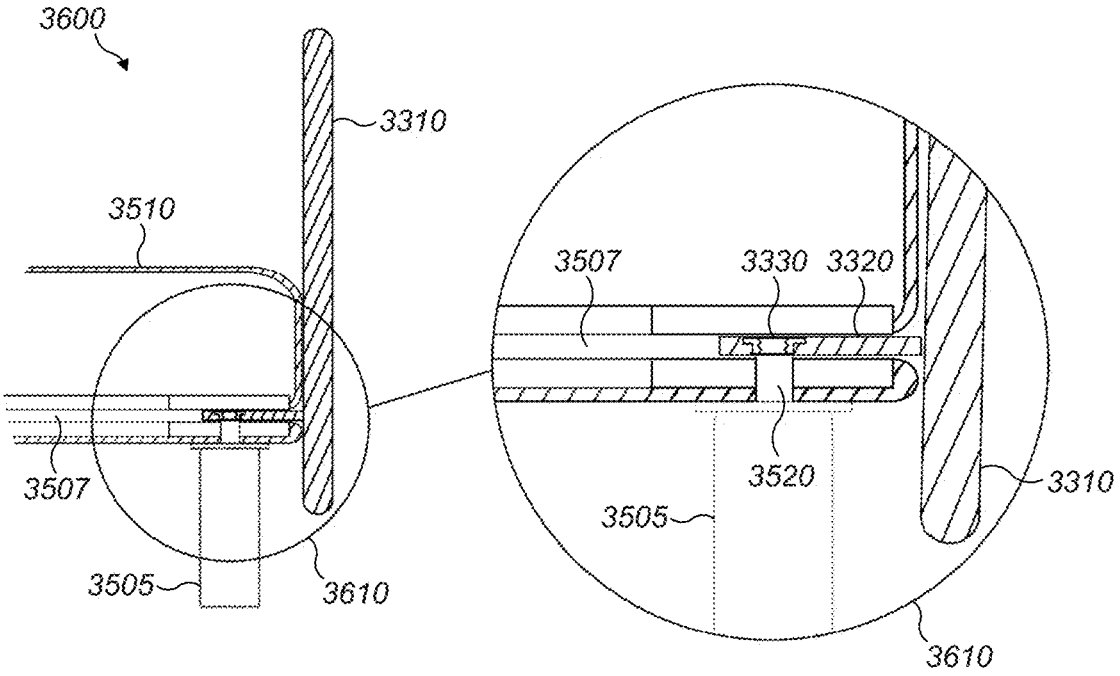
FIG. 36 shows a cross-section view of a T-shaped panel being inserted and secured into a universal base platform.

Turning to FIG. 36, shown is a cross-section view 3600 of the T-Shaped panel fully inserted into a cavity of a universal base. Shown is a universal base 3510 and an inset circle 3610. The inset circle 3610 shows a cavity 3507 where the vertical section 3310 of the T-shaped panel is attached to the horizontal section 33320 that is inserted into the cavity 3507 such that the threaded hole 3330 matches the pass-through hole 3520. The leg 3505 is shown inserted into the universal base 3510 behind the T-shaped panel.

Figure 37:
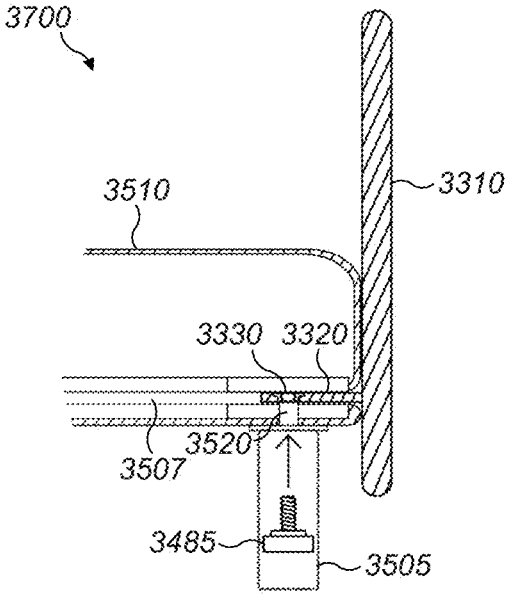
FIG. 37 shows a further cross-section view of a T-shaped panel being inserted and secured into a universal base platform.
Figure 38:
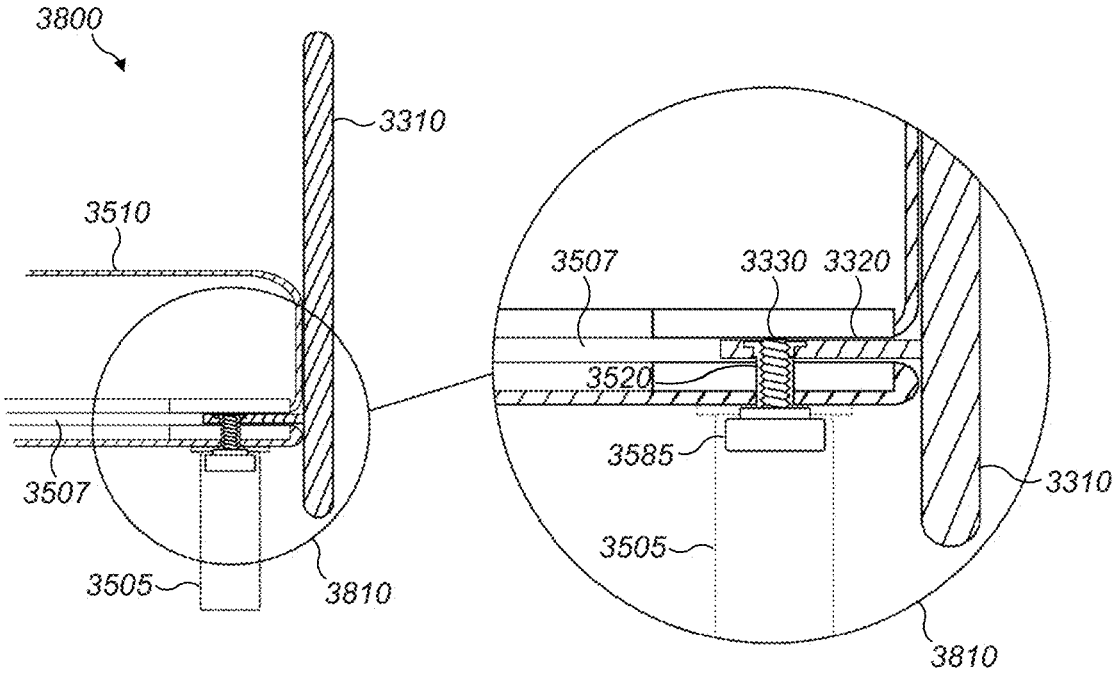
FIG. 38 shows a further cross-section view of a T-shaped panel being inserted and secured into a universal base platform.

Turning to FIGS. 37 and 38, shown are cross-section views 3700 3800 of a T-shaped panel being further secured to a universal base. Shown in FIG. 37 is a universal base 3310 having a cavity 3507 where the vertical section 3310 of the T-shaped panel is attached to the horizontal section 3320 that is inserted into the cavity 3507 such that the threaded hole 3330 matches the hole pass-through hole 3520. To further secure the T-shaped panel, a threaded bolt 3585 is about to be inserted into the pass-through hole 3520 and threaded hole 3330. Shown in FIG. 38 in inset circle 3810 is the threaded bolt 3585 inserted in threaded hole 3330 and the pass-through hole 3520, thereby further securing the horizontal section 3320.

Thus, the T-shaped panel may be attached to the universal base while the universal base is standing on legs with the platform A side up. The horizontal surface of the panel may be inserted into the cavity on any side of the universal base, as in FIG. 35. Once the horizontal surface is fully inserted into the cavity, the T-shaped panel may remain in place with no additional support. This allows a single person to assemble the modular lounge seating, as in FIG. 36.

When the horizontal surface of the T-shaped panel is fully inserted into cavity of the universal base, the threaded insert in the horizontal surface of the T-shaped panel will align with the pass-through hole in platform B of the universal base, as in FIG. 36. This will allow a threaded bolt to be inserted through the pass-through hole in the universal base and fasten into the threaded insert in the horizontal surface of the T-shaped panel, as in FIG. 37. By tightening the threaded bolt, the horizontal surface of the T-Shaped Panel is pulled tight against the top side of platform B inside the cavity, as in FIG. 38.

E. Cushions

Figure 39:
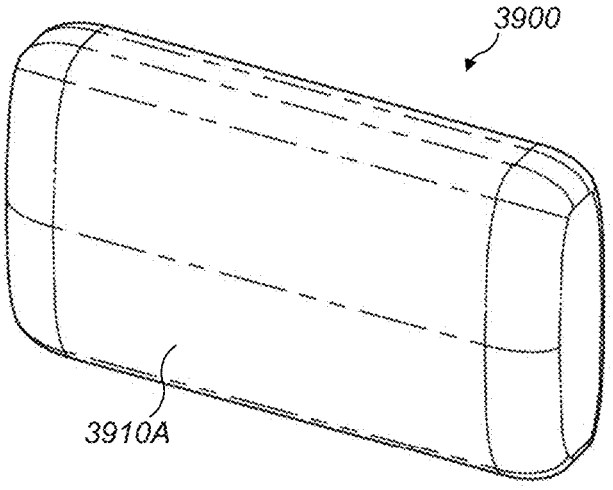
FIG. 39 shows a view of a modular couch cushion.
Figure 40:
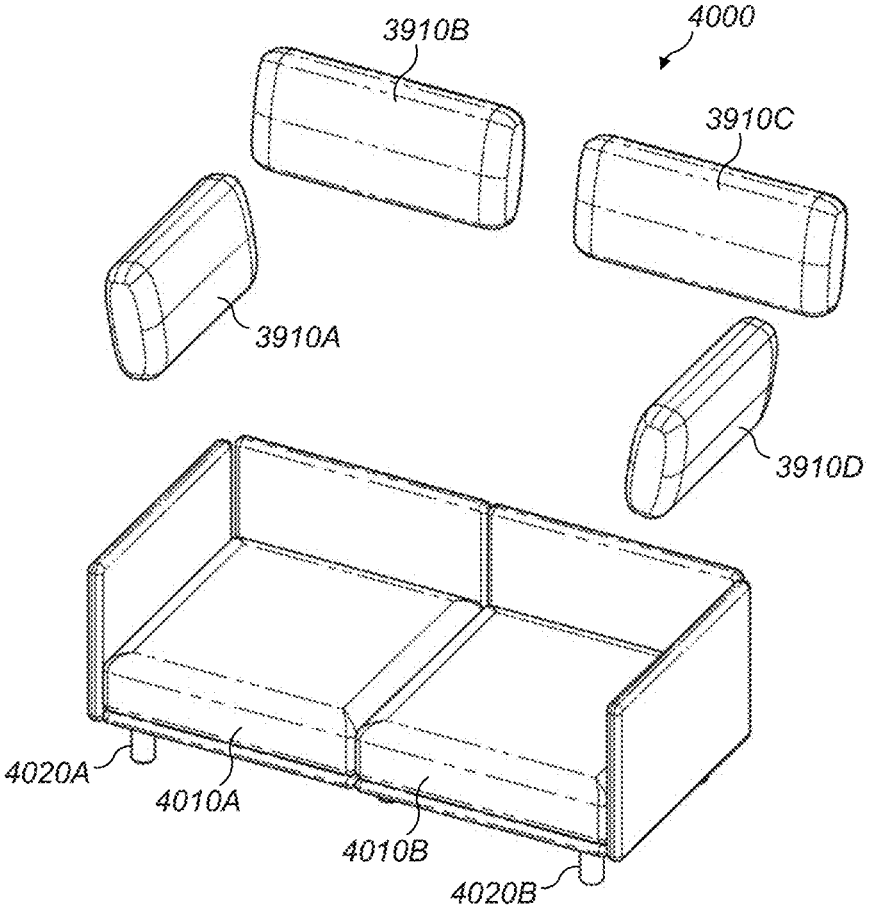
FIG. 40 shows views of a modular couch.

Turning to FIG. 39, shown is a schematic view 3900 of a cushion 3910A. Cushions of various shapes and sizes can be placed on top of the universal base and leaned against T-shaped panels. Turning to FIG. 40, shown is a schematic 4000 with a number of cushions 3910A 3910B 3910C 3910D are about to be placed onto universal bases 4010A 4010B, which are supported by legs 4020A 4020B (and other legs not shown).

F. Couch Assemblies

Figure 41:
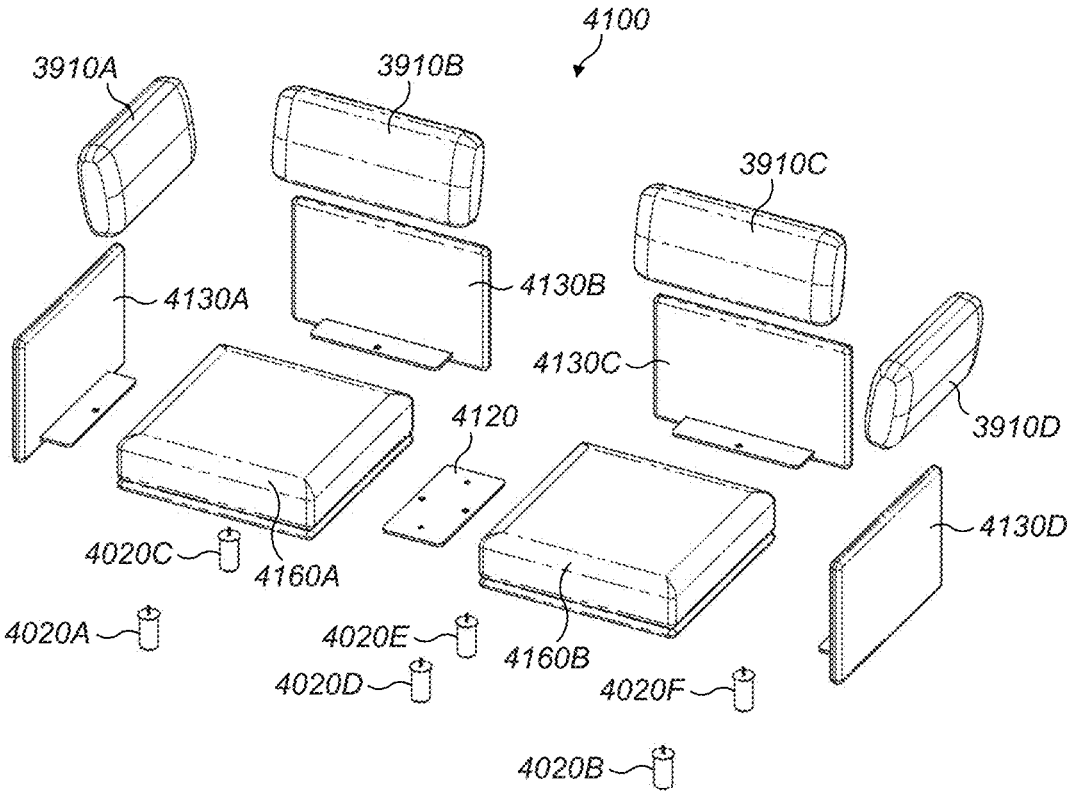
FIG. 41 shows further views of a modular couch.
Figure 42:
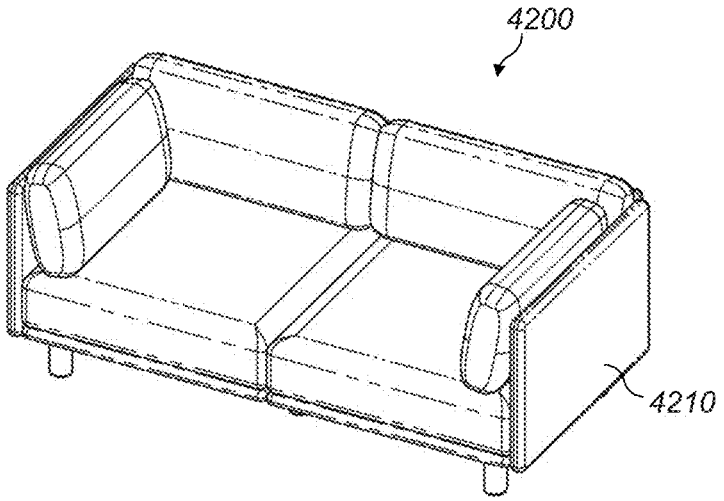
FIG. 42 shows further views of a modular couch.

Turning to FIGS. 41 and 42, shown is a exploded view 4100 in FIG. 41 illustrating how the schematic view 4200 in FIG. 42 is assembled. Specifically, the universal bases 4160A 4160B are connected using the joining plate 4120 and supported by legs 4020A 4020B 4020C 4020D 4020E 4020F. First and second T-shaped panels 4130A 4130B are secured into a first universal base 4160A and support first and second cushions 3910A 3910B. Third and fourth T-shaped panels 4130C 4130D are secured into a first universal base 4160B and support third and fourth cushions 3910C 3910D. All of these may be assembled into a completed couch 4210.

Figure 43:
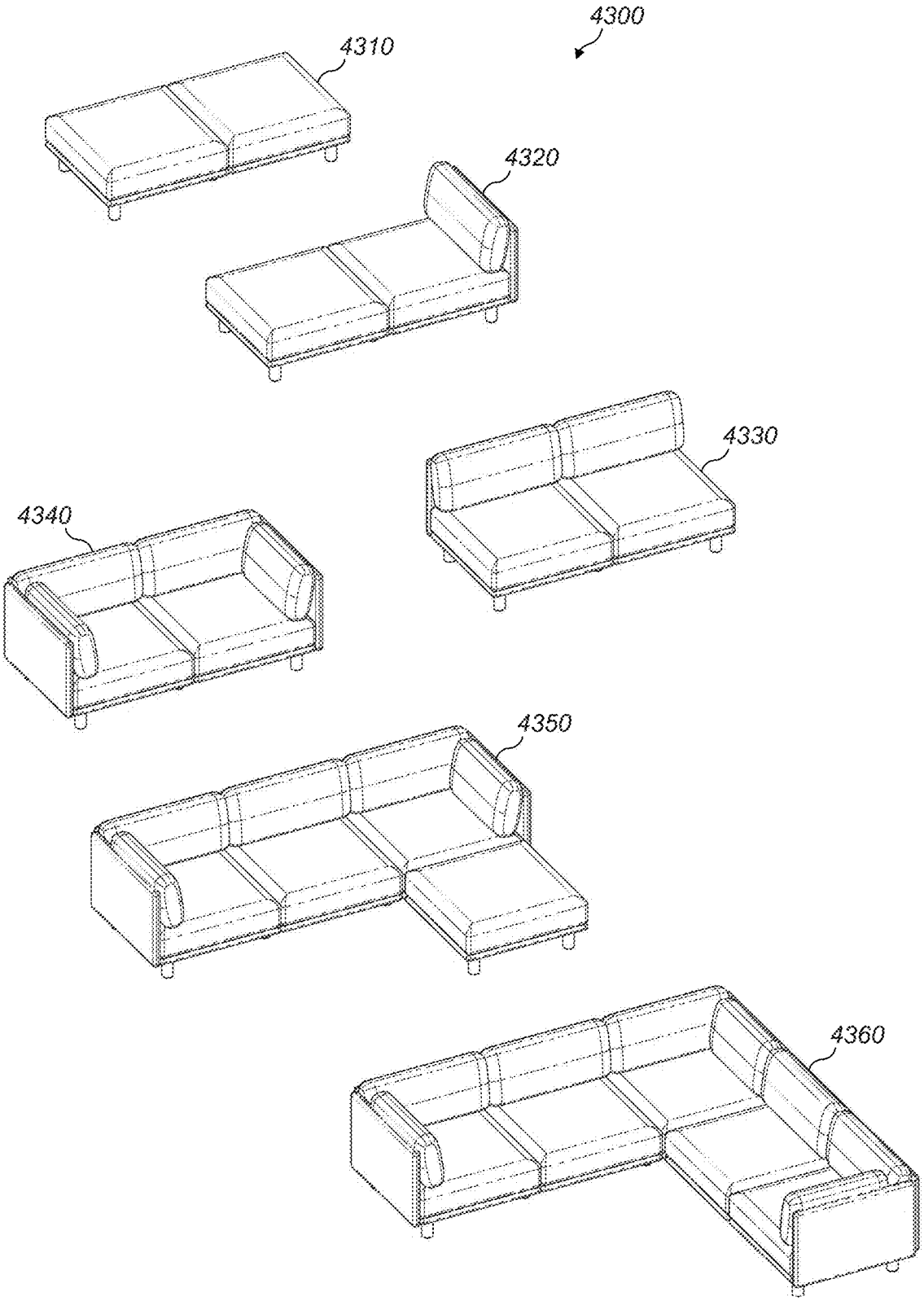
FIG. 43 shows further views of a modular couch.

FIG. 43 shows schematic views 4300 of other various couch arrangements. These arrangements include a backless bench 4310, a backless bench with a side cushion 4320, a bench with a back 4330, a couch with side cushions 4340, a couch with a chaise 4350, and a sectional couch 4360.

Thus, cushions as in FIG. 39 of various shape and sizes may be placed on top of the universal base and leaned against the T-shaped panels and used with legs and joining plates as in FIGS. 40 and 41 to provided desired look and feel of finished modular lounge seating as in FIG. 42. With different quantities and combinations of universal bases, joining plates, legs, T-shaped panels and cushions, a wide variety of seating configurations including armless and backless styles, sectionals and chaise styles may be achieved, as in FIG. 43.

G. Alternative Assemblies

Figure 44:
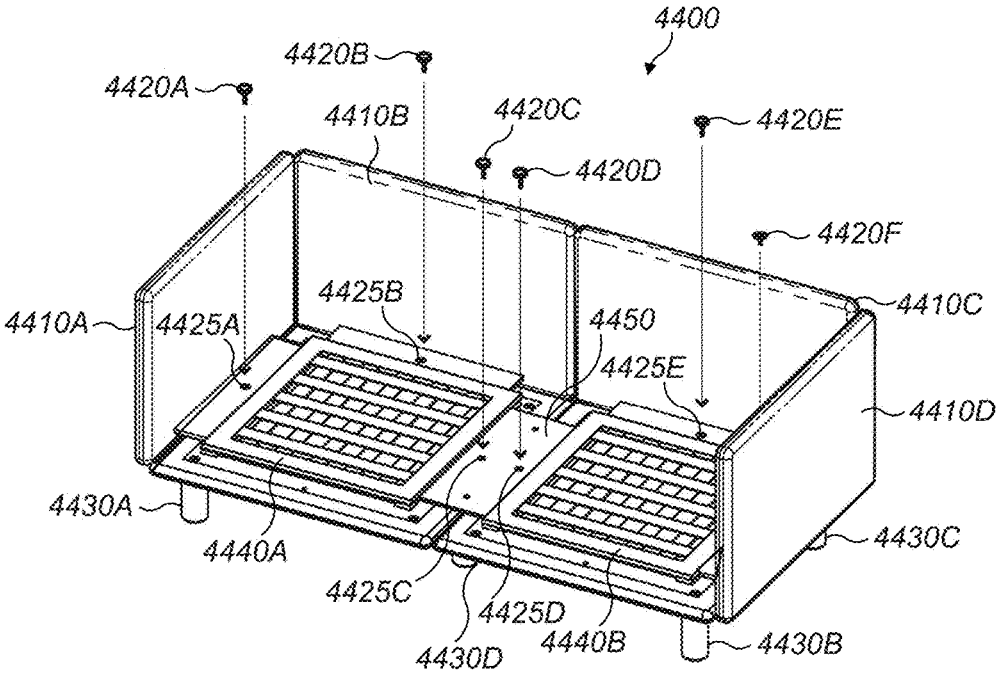
FIG. 44 shows a view of a disassembled modular couch.

Turning to FIG. 44, shown is a schematic view 4400 of a partially assembled couch with the universal base tops removed. The partially assembled couch is supported by legs 4430A 4430B 4430C 4430D and a fifth and sixth leg not shown. T-shaped panels 4410A 4410B 4410C 4410D form the back and sides of the couch. Platform 4440A 4440B are placed on the bottom of the couch with a joining plate 4450 installed between them. Since the platforms 4440A 4440B have cavities, portions of the T-shaped panels 4410A 4410B 4410C 4410D and the joining plate 4450 are inserted into these cavities prior to being secured by threaded bolts 4420A 4420B 4420C 4420E 4420F through threaded holes 4425A 4425B 4425C, 4425D, 4425E, and a sixth threaded hole not shown.

Figure 45:
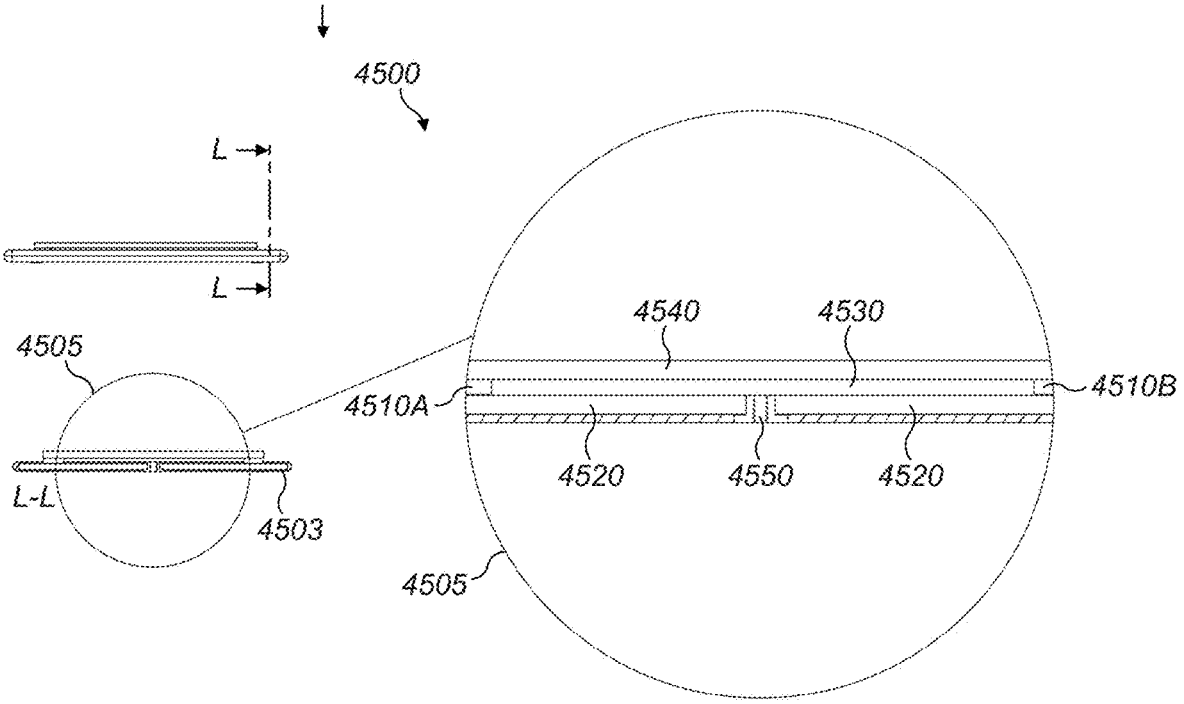
FIG. 45 shows cross-section views of a universal base platform.

Turning to FIG. 45, shown is a cross-section L-L view 4500 of a platform 4503 that may be used in FIG. 44. In the inset circle 4505, shown is the open cavity 4530 between the top platform portion 4540 and bottom platform portion 4520 separated by spacers 4510A 4510B. A threaded hole 4550 in the center of the cross-section is also shown. In this alternative arrangement, threaded holes are embedded within the platforms of the universal base platforms in place of the pass-through holes.

Figure 46:
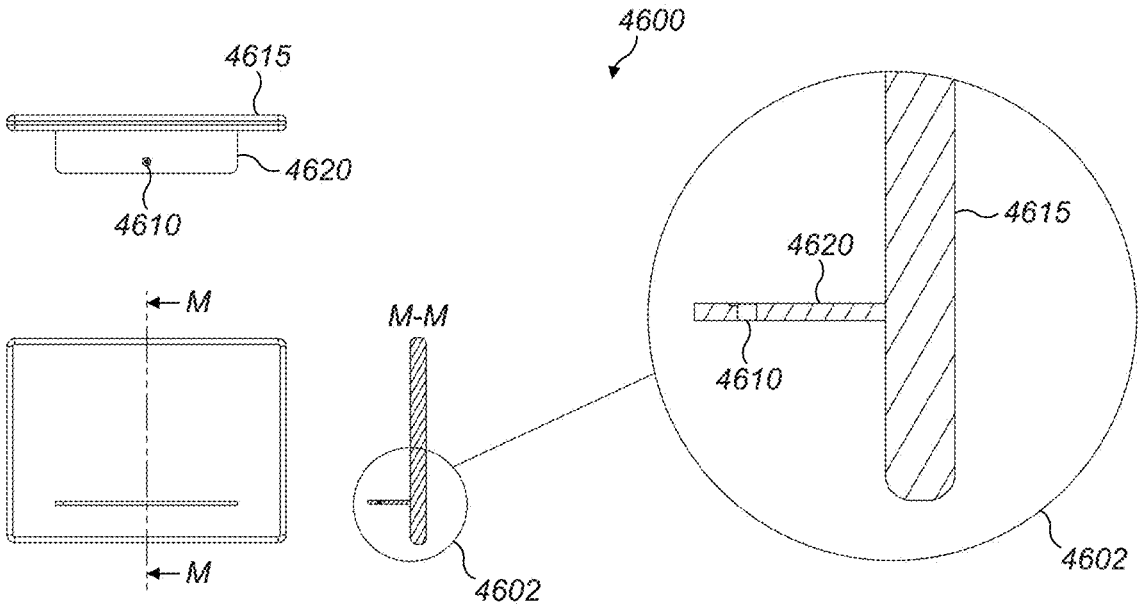
FIG. 46 shows cross-section views of an alternative T-shaped panel.

Turning to FIG. 46, shown is a cross-section M-M view of a T-shaped panel that may be used in FIG. 44 consisting of a vertical surface 4615 and a horizontal surface 4620 connected with a side of the vertical surface 4615 forming a sideways asymmetrical T. The horizontal surface includes a pass-through hole 4610. The inset circle 4602 shows a cross-section of the vertical surface 4615, horizontal surface 4620, and a pass-through hole 4610. In this alternative arrangement, a pass-through hole is embedded within the T-shaped panel in place of the hole with threaded inserts.

Figure 47:
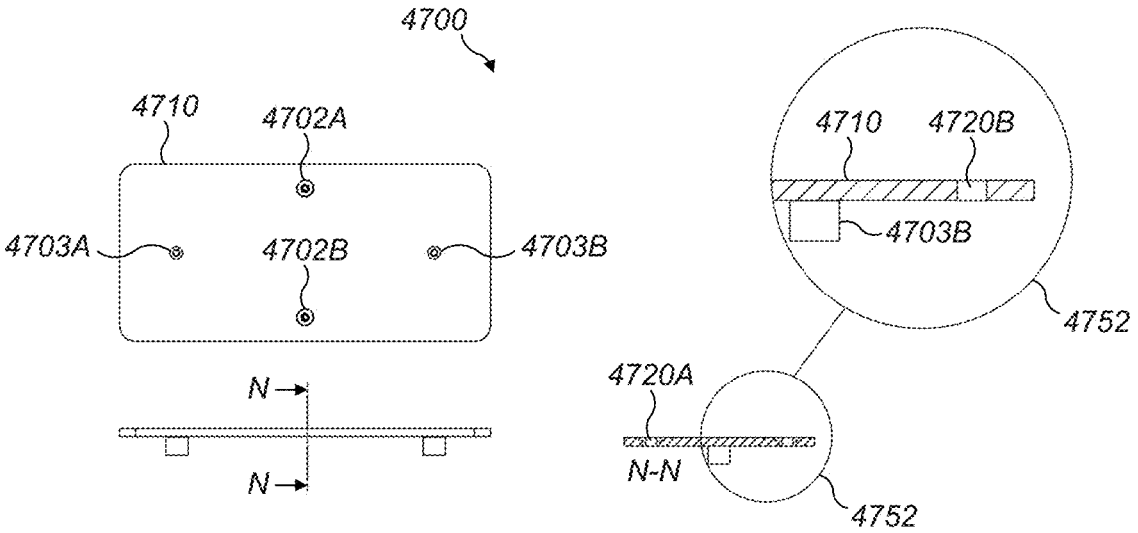
FIG. 47 shows cross-section views of an alternative joining plate.

Turning to FIG. 47, shown is a cross-section N-N view of a joining plate 4710 that may be used in FIG. 44. The joining plate 4710 includes two platform connection pass-through holes 4702A 4702B and two joining plate leg connection tubes 4703A 4703B that have thread tubes protruding from them in one direction. Shown is a cross section of a platform connection pass-through hole 4720A. Within the inset circle 4752, also shown is a cross section of the joining plate 4710 with a platform connection pass-through hole 4720B and the front of a leg connection tube 4703B in the background. In this alternative arrangement, pass-through holes are embedded within the joining plate in place of the holes with threaded inserts. The two joining plate leg connection tubes 4703A 4703B remain the same.

Figure 48:
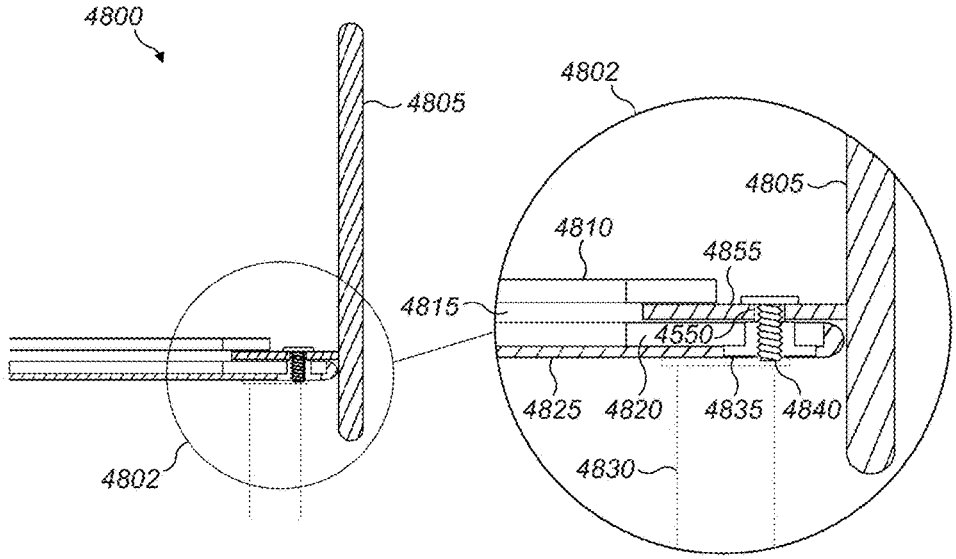
FIG. 48 shows a cross section view of an alternative T-shaped panel being secured to the alternative universal base platform.

Turning to FIG. 48, shown is a cross-section view 4800 of a T-shaped panel inserted into, and secured within, the cavity of a base platform. Shown is the vertical portion 4805 of a T-shaped panel. Within the inset circle 4802, shown is the horizontal portion 4855 inserted into the cavity 4815 of the platform 4825 formed within the upper platform portion 4810 and lower platform portion 4820. A top-loading threaded bolt 4840 is inserted into the pass-through hole 4550 in the in the horizontal portion 4855 and secured to the lower platform portion 4820 via a hole with threaded insert 4835. This secures the T-shaped panel to the base platform. Also shown is a leg 4830 that is secured to the platform separately with a mechanism (not shown) behind the T-shaped panel. Because the horizontal surface 4485 does not extend the entire length of the vertical surface 4805 (as in FIG. 46), the leg 4830 may be so attached without interfering with the horizontal surface 4485.

Figure 49:
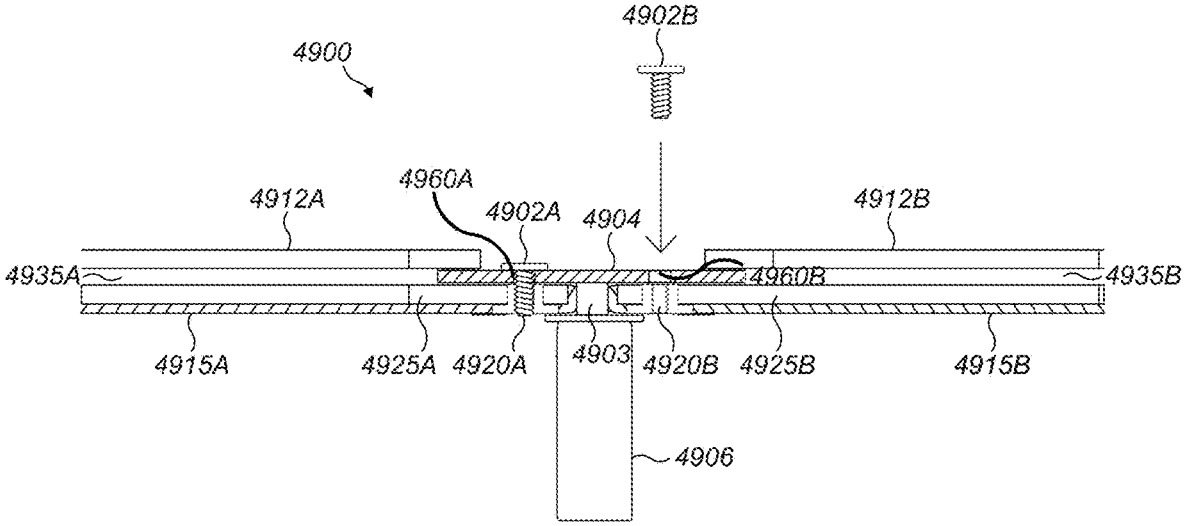
FIG. 49 shows a cross section view of an alternative joining plate being secured to two alternative universal base platforms.

Turning to FIG. 49, shown is a cross-section view 4900 of a joining plate 4904 inserted into, and secured within, the cavity of two adjoining base platforms 4915A 4915B The base platforms 4915A 4915B include a top portion 4912A 4912B and a bottom portion 4925A 4925B with a cavity 4935A 4935B therebetween. The joining plate 4904 is inserted into the cavities 4935A 4935B and is then secured by top-loading threaded bolts 4902A 4902B that are screwed through the pass-through holes 4960A 4960B of the joining plate 4904 and into the threaded holes 4920A 4920B of the bottom portions 4925A 4925B. Behind these connections, a leg 4906 is secured within a joining plate leg connection tube 4903.

One advantage of this alternative arrangement as in FIGS. 44, 45, 46, 47, 48, and 49 is that after the legs are installed, all of the securing mechanisms described herein may be fastened from above. This means that the assembler need not turn the couch upside down in order to assemble the couch system, thus saving time and exertion.

H. General

The configurations and figures discussed above are not limiting in any fashion as different sizes and shapes of components made of any durable material may be used in accordance with the inventions described herein. Thus, the universal base platform having a cavity and connection holes, legs, joining plates, T-shaped panels, and cushions, may be of any shape and size and may consist of any durable material while maintaining their ability to be joined together in a manner described herein. The universal base platform having a cavity and connection holes, legs, joining plates, T-shaped panels, and cushions may be shaped in square, rectangular, triangular, circular, oval, elliptical, or other form factors. Provided that the universal base platform has a cavity (whether created by spacers, U-channels, or other mechanisms) capable of receiving the joining plate, the T-shaped panel, or other similar mechanisms of any shape or size, the nature of the foregoing arrangements may be maintained.

The universal base platform may or may not have a removable cushion. Although the embodiments described above in the "Alternative Assemblies" section envision a removable cushion in order for the threaded bolts to access the securing mechanisms from above, the universal base platform may instead have a non-removable cushion along with selectively retractable sections that allow for temporary access by the threaded bolts from above the universal base platform. Once the threaded bolts are used to secure the joining plate, T-shaped panel, or other mechanism, the selectively retractable sections may be restored to their original positions.

In addition, the foregoing embodiments disclosed a threaded bolt that secures components via a pass-through hole in a first component and via a threaded hole in a second component. It is also possible to use a threaded bolt to secure components via a first threaded hole from a first component a via a second threaded hole from a second component. It is also possible to use a threaded bolt to secure components via a first pass-through hole in a first component and via a second pass-through hole in a second component, provided that another mechanism is used to secure the threaded bolt to the two components. The other securing mechanism may be a nut attached to the end of the threaded bolt. It is also possible to secure more than two components together using all threaded holes, all pass-through holes (with an additional securing mechanism), or a combination thereof. It is also possible to use a securing mechanism other than a threaded bolt alone, including a nail, dowel, pin, or the like. It is also possible to use an adhesive in place of, or in addition to, the foregoing.

It is also possible to fashion and install a single T-shaped panel to be inserted into more than one universal base platform. It is also possible to fashion and install a joining plate to be inserted into more than two universal base platforms. It is also possible to fashion and install a joining plate without leg connection holes.

II. Conclusion

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover, in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

I claim:

1. A system comprising:

a first base platform having a first upper portion, a first lower portion, a first cavity created by separation of the first upper portion and the first lower portion, and a first base platform securing hole;

a second base platform having a second upper portion, a second lower portion, a second cavity created by separation of the second upper portion and the second lower portion, and a second base platform securing hole;

a joining plate having a first joining plate securing hole, a second joining plate securing hole, and at least one joining plate leg connection tube;

at least one center leg having a leg threaded rod secured to the at least one of the joining plate leg connection tube via the leg threaded rod for supporting the first base platform and the second base platform;

a first securing mechanism for securing the first base platform to the joining plate via the first base platform securing hole and via the first joining plate securing hole after a first portion of the joining plate is inserted into the first cavity without interfering with the at least one center leg; and a second securing mechanism for securing the second base platform to the joining plate via the second base platform securing hole and via the second joining plate securing hole after a second portion of the joining plate is inserted into the second cavity without interfering with the at least one center leg.

2. The system as in claim 1, wherein the separation of the first upper portion and the first lower portion is created by a first set of at least one spacer, and the separation of the second upper portion and the second lower portion is created by a second set of at least one spacer.

3. The system as in claim 2, wherein the first set of at least one spacer comprises a set of first spacers installed in corners of the first cavity; and wherein the second set of at least one spacer comprises a set of second spacers installed in corners of the second cavity.

4. The system as in claim 1, wherein the separation of the first upper portion and the first lower portion is created by a first U-channel having a first U-channel upper leg and first U-channel lower leg, wherein the first U-channel is positioned on its side, wherein the first U-channel upper leg acts as part of the first upper portion and the first U-channel lower leg acts as part of the first lower portion; and the separation of the second upper portion and the second lower portion is created by a second U-channel having a second U-channel upper leg and second U-channel lower leg, wherein the second U-channel is positioned on its side, wherein the second U-channel upper leg acts as part of the second upper portion and the second U-channel lower leg acts as part of the second lower portion.

5. The system as in claim 1, wherein the first securing mechanism comprises a first threaded bolt, and the second securing mechanism comprises a second threaded bolt.

6. The system as in claim 5, wherein the first base platform securing hole is a pass-through hole, the second base platform securing hole is a pass-through hole, the first joining plate securing hole is a threaded hole, and the second joining plate securing hole is a threaded hole.

7. The system as in claim 5, wherein the first base platform securing hole is a threaded hole, the second base platform securing hole is a threaded hole, the first joining plate securing hole is a pass-through hole, and the second joining plate securing hole is a pass-through hole.

8. The system as in claim 7, wherein the first upper portion comprises a first removable cushion;

wherein the second upper portion comprises a second removable cushion;

wherein the first securing mechanism is installed from a top of the first base platform after removal of the first removable cushion; and wherein the second securing mechanism is installed from a top of the second base platform after removal of the second removable cushion.

9. The system as in claim 5, further comprising:

at least one first leg secured to a bottom of the first base platform; and at least one second leg secured to a bottom of the second base platform.

10. A system comprising:

a base platform having an upper portion, a lower portion, a cavity created by separation of the upper portion and the lower portion, and a first base platform securing hole;

a first panel comprising a first vertical surface having a first vertical surface width and a first horizontal surface connected to a side of the first vertical surface, wherein the first horizontal surface has a first panel securing hole and wherein the first horizontal surface does not extend across all of the first vertical surface width;

at least one leg secured to a bottom corner of the first base platform; and a first securing mechanism for securing the base platform to the first panel via the first base platform securing hole and via the first panel securing hole while the first horizontal surface is inserted into the cavity without interfering with the at least one leg secured to the bottom corner of the first base platform.

11. The system as in claim 10, wherein the separation of the upper portion and the lower portion is created by at least one spacer installed in corners of the cavity.

12. The system as in claim 10, wherein the separation of the upper portion and the lower portion is created by a U-channel having a U-channel upper leg and U-channel lower leg, wherein the U-channel is positioned on its side, wherein the U-channel upper leg acts as part of the upper portion and the U-channel lower leg acts as part of the lower portion.

13. The system as in claim 10, wherein the base platform further comprises a second base platform securing hole; and further comprising:

a second panel comprising a second vertical surface having a second vertical surface width and a second horizontal surface connected to a side of the second vertical surface, wherein the second horizontal surface has a second panel securing hole and wherein the second horizontal surface does not extend across all of second first vertical surface width;

a second securing mechanism for securing the base platform to the second panel via the second base platform securing hole and via the second panel securing hole while the second horizontal surface is inserted into the cavity without interfering with the at least one leg secured to a bottom corner of the first base platform.

14. The system as in claim 13, wherein the first securing mechanism comprises a first threaded bolt, and the second securing mechanism comprises a second threaded bolt.

15. The system as in claim 14, wherein the first base platform securing hole is a pass-through hole, the second base platform securing hole is a pass-through hole, the first panel securing hole is a threaded hole, and the second panel securing hole is a threaded hole.

16. The system as in claim 14, wherein the first base platform securing hole is a threaded hole, the second base platform securing hole is a threaded hole, the first panel securing hole is a pass-through hole, and the second panel securing hole is a pass-through hole.

17. The system as in claim 16, wherein the upper platform comprises a removable cushion; and wherein the first securing mechanism and the second securing mechanism is installed from a top of the base platform after removal of the removable cushion.

18. The system as in claim 14, wherein the first panel supports a first cushion, and the second panel supports a second cushion.

19. A system comprising:

a first base platform having a first upper portion, a first lower portion, a first cavity created by separation of the first upper portion and the first lower portion, a first base platform securing hole and a second base platform securing hole;

a first leg secured to a bottom of the first base platform;

a second base platform having a second upper portion, a second lower portion, a second cavity created by separation of the second upper portion and the second lower portion, a third base platform securing hole and a fourth base platform securing hole;

a second leg secured to a bottom of the second base platform;

a joining plate having a first joining plate securing hole, a second joining plate securing hole, and at least one joining plate leg connection tube;

at least one center leg having a leg threaded rod secured to the at least one of the connection tube securing holes via the leg threaded rod for supporting the first base platform and the second base platform; a first panel comprising a first vertical surface and a first horizontal surface connected with a portion of a side of the first vertical surface, the first horizontal surface having a first panel securing hole;

a second panel comprising a second vertical surface and a second horizontal surface connected with a portion of a side of the second vertical surface, the second horizontal surface having a second panel securing hole;

a first securing mechanism for securing the first base platform to the joining plate via the first base platform securing hole and via the first joining plate securing hole while a first portion of the joining plate is inserted into the first cavity without interfering with the at least one center leg; and a second securing mechanism for securing the second base platform to the joining plate via the third base platform securing hole and via the second joining plate securing hole while a second portion of the joining plate is inserted into the second cavity without interfering with the at least one center leg;

a third securing mechanism for securing the first base platform to the first panel via the second base platform securing hole and via the first panel securing hole while the first horizontal surface is inserted into the first cavity without interfering with the first leg; and a fourth securing mechanism for securing the second base platform to the second panel via the fourth base platform securing hole and via the second panel securing hole while the second horizontal surface is inserted into the second cavity without interfering with the second leg.

20. The system as in claim 19, wherein the first securing mechanism is a threaded bolt, the second securing mechanism is a threaded bolt, the third securing mechanism is a threaded bolt, and the fourth securing mechanism is a threaded bolt.

21. A system comprising:

a first base platform having a first upper portion, a first lower portion, a first cavity created by separation of the first upper portion and the first lower portion, and a first base platform securing hole, wherein the separation of the first upper portion and the first lower portion is created by a first U-channel having a first U-channel upper leg and first U-channel lower leg, wherein the first U-channel is positioned on its side, wherein the first U-channel upper leg acts as part of the first upper portion and the first U-channel lower leg acts as part of the first lower portion;

a second base platform having a second upper portion, a second lower portion, a second cavity created by separation of the second upper portion and the second lower portion, and a second base platform securing hole, wherein the separation of the second upper portion and the second lower portion is created by a second U-channel having a second U-channel upper leg and second U-channel lower leg, wherein the second U-channel is positioned on its side, wherein the second U-channel upper leg acts as part of the second upper portion and the second U-channel lower leg acts as part of the second lower portion;

a joining plate having a first joining plate securing hole and a second joining plate securing hole;

a first securing mechanism for securing the first base platform to the joining plate via the first base platform securing hole and via the first joining plate securing hole while a first portion of the joining plate is inserted into the first cavity; and a second securing mechanism for securing the second base platform to the joining plate via the second base platform securing hole and via the second joining plate securing hole while a second portion of the joining plate is inserted into the second cavity;

wherein the first upper portion comprises a first removable cushion;

wherein the second upper portion comprises a second removable cushion;

wherein the first securing mechanism is installed from a top of the first base platform after removal of the first removable cushion; and wherein the second securing mechanism is installed from a top of the second base platform after removal of the second removable cushion.

22. The system as in claim 21, wherein the first securing mechanism comprises a first threaded bolt, and the second securing mechanism comprises a second threaded bolt.

23. The system as in claim 22, wherein the first base platform securing hole is a pass-through hole, the second base platform securing hole is a pass-through hole, the first joining plate securing hole is a threaded hole, and the second joining plate securing hole is a threaded hole.

24. The system as in claim 22, wherein the first base platform securing hole is a threaded hole, the second base platform securing hole is a threaded hole, the first joining plate securing hole is a pass-through hole, and the second joining plate securing hole is a pass-through hole.

25. The system as in claim 22, further comprising:

at least one second leg secured to a bottom of the first base platform; and at least one third leg secured to a bottom of the second base platform.

* * * * *